US010737368B2

(12) United States Patent
Efird et al.

(10) Patent No.: US 10,737,368 B2
(45) Date of Patent: Aug. 11, 2020

(54) ELECTROCHEMICAL CORROSION OF CATALYST MATERIAL FROM PCD ELEMENTS

(71) Applicant: NATIONAL OILWELL VARCO, L.P., Houston, TX (US)

(72) Inventors: K Daniel Efird, The Woodlands, TX (US); Walter Rothrock, New Caney, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 179 days.

(21) Appl. No.: 15/514,448

(22) PCT Filed: Sep. 25, 2015

(86) PCT No.: PCT/US2015/052266

§ 371 (c)(1),
(2) Date: Mar. 24, 2017

(87) PCT Pub. No.: WO2016/049480

PCT Pub. Date: Mar. 31, 2016

(65) Prior Publication Data

US 2017/0282334 A1 Oct. 5, 2017

Related U.S. Application Data

(60) Provisional application No. 62/055,778, filed on Sep. 26, 2014.

(51) Int. Cl.
*B24D 18/00* (2006.01)
*C25F 3/02* (2006.01)
(Continued)

(52) U.S. Cl.
CPC ..... *B24D 18/0018* (2013.01); *C25F 3/02* (2013.01); *C25F 7/00* (2013.01); *E21B 10/55* (2013.01)

(58) Field of Classification Search
CPC ..... C25F 3/02
(Continued)

(56) References Cited

U.S. PATENT DOCUMENTS 3,357,905 A * 12/1967 Faust ..... B23H 3/08 205/674
4,234,333 A * 11/1980 Ghandehari ..... C01B 32/949 205/557
(Continued)

FOREIGN PATENT DOCUMENTS

GB 2548250 A 9/2017
WO 2016049480 A1 3/2013

OTHER PUBLICATIONS https://www3.nd.edu/~kamatlab/documents/facilities/potentiostat.pdf (Year: 2018).*
(Continued)

*Primary Examiner* — Brian W Cohen
(74) *Attorney, Agent, or Firm* — Conley Rose, P.C.

(57) ABSTRACT

A method of treating a cutter element comprises contacting at least a portion of a volume of polycrystalline diamond with an electrolyte solution, applying an electrical current between the volume of the polycrystalline diamond and a counter electrode to maintain a predetermined electrochemical potential between a reference electrode and the volume of polycrystalline diamond, and corroding at least a portion of the catalyst material from the interstitial spaces between the diamond grains in the volume of polycrystalline diamond. The volume of the polycrystalline diamond comprises interbonded diamond grains and a catalyst material disposed in the interstitial spaces between adjacent diamond grains in the volume of polycrystalline diamond. The counter electrode is in contact with the electrolyte solution, and the electrical current is supplied at a substantially constant
(Continued)

electrochemical potential between a reference electrode and the volume of polycrystalline diamond.

16 Claims, 13 Drawing Sheets

(51) Int. Cl.
*C25F 7/00* (2006.01)
*E21B 10/55* (2006.01)

(58) Field of Classification Search
USPC ..... 205/674–685
See application file for complete search history.

(56) References Cited

U.S. PATENT DOCUMENTS 5,384,016 A 1/1995 Lin et al.
5,700,518 A 12/1997 Lee et al.
6,344,149 B1 2/2002 Oles
2005/0145508 A1* 7/2005 Larsen ..... A61L 31/022 205/684
2009/0308760 A1* 12/2009 Wei ..... B23H 9/001 205/654
2013/0001100 A1 1/2013 Thigpen et al.
2013/0291447 A1 11/2013 Mazyar

OTHER PUBLICATIONS

Potentiostat Fundamentals, Jun. 30, 2014. https://electrochemistryresources.com/potentiostat-fundamentals/ (Year: 2014).*
Foreign Communication From a Related Counterpart Application, International Preliminary Report on Patentability dated Apr. 6, 2017, International Application No. PCT/US2015/052266 filed on Sep. 25, 2015.
Foreign Communication From a Related Counterpart Application, International Search Report and Written Opinion dated Dec. 22, 2015, International Application No. PCT/US2015/052266 filed on Sep. 25, 2015.

* cited by examiner

ELECTROCHEMICAL CORROSION OF CATALYST MATERIAL FROM PCD ELEMENTS

CROSS-REFERENCE TO RELATED APPLICATIONS

The present application is a filing under 35 U.S.C. 371 as the National Stage of International Application No. PCT/US2015/052266, filed Sep. 25, 2015, entitled "ELECTROCHEMICAL CORROSION OF CATALYST MATERIAL FROM PCD ELEMENTS," which claims priority to U.S. Provisional Application No. 62/055,778 filed with the United States Patent and Trademark Office on Sep. 26, 2014 and entitled "ELECTROCHEMICAL CORROSION OF CATALYST MATERIAL FROM PCD ELEMENTS," both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Oil and gas drilling operations often employ drill bits to drill through various rock formations in an effort to access hydrocarbon reserves below the ground. One common type of drill bit typically employs a plurality of cutter elements that engage, scrape, and shear the earthen formation being drilled through. Such cutter elements are typically made of a layer or table of Polycrystalline Diamond ("PCD") bonded to a cobalt cemented, tungsten carbide (WC) substrate.

In general, a PCD table for a cutter element is manufactured and bonded to a substrate. During the manufacturing process, a catalyst material is used to form diamond-diamond bonds between individual diamond grains in a high-temperature high-pressure process. The resulting PCD table may then have the catalyst material disposed within the interstitial spaces between the bonded diamond grains.

During drilling operations, cutter elements experience relatively high temperatures due, at least in part, to the general nature of the downhole environment and to friction between the cutter elements and the formation. The thermal loads result in expansion of the material components of the cutter elements. Due to differences in the coefficients of thermal expansion between the catalyst and the diamond grains in the PCD table, at sufficiently high temperatures, undesirable cracks may form in the PCD lattice structure of the table. Such cracks can lead to failure of the cutter element, reduced cutting efficiency, and reduced cutting effectiveness. Additionally, high thermal loads can also lead to the formation of materials such as, for example, carbon monoxide, carbon dioxide, and/or graphite within the PCD table itself, which can further reduce the effectiveness and strength of the cutter element. Accordingly, it is desirable to remove at least a portion of the catalyst from a PCD table after its formation to enhance the cutter elements' durability over a broader range of operating temperatures.

A common approach to removing the catalyst from a PCD table is to leach the PCD table to remove some or substantially all of the interstitial catalyst from the PCD lattice structure, thereby transforming the PCD table into thermally stable polycrystalline diamond. Leaching typically involves placing the cutter element in a strong acid bath at an elevated temperature to expose the PCD table to the acid. Suitable acids for leaching include nitric acid, sulfuric acid, hydrofluoric acid, hydrochloric acid, and combinations thereof. Conventional leaching processes typically require long periods of time in order to allow the leaching acid to remove the desired amount of catalyst from a given PCD table. In some cases, a PCD cutter element must remain within the leaching acid for up to three weeks in order to obtain the desired result. This relatively long time requirement reduces the flexibility available in manufacturing PCD cutter elements, thereby increasing the costs associated therewith.

SUMMARY

In an embodiment, a method of treating a cutter element comprises contacting a volume of polycrystalline diamond with an electrolyte solution, using electrochemical corrosion principles to accelerate the corrosion of the catalyst material in the matrix by applying an electrical current between the volume of the polycrystalline diamond and a counter electrode, and corroding at least a portion of the catalyst material from the interstitial spaces between the diamond grains. The volume of the polycrystalline diamond comprises interbonded diamond grains and a catalyst material disposed in at least some of the interstitial spaces between adjacent diamond grains. A counter electrode in contact with the electrolyte solution is employed to supply the electrical current while maintaining a substantially constant electrochemical potential on the polycrystalline diamond with respect to a reference electrode.

In an embodiment, a method of treating a cutter element comprising: contacting a volume of polycrystalline diamond with an electrolyte solution, and potentiostatically corroding at least a portion of the catalyst material from the interstitial spaces between the diamond grains in the volume of polycrystalline diamond. The volume of the polycrystalline diamond comprises interbonded diamond grains and a catalyst material disposed in at least some of the interstitial spaces between adjacent diamond grains. Potentiostatically corroding at least the portion of the catalyst material from the interstitial spaces comprises maintaining an electrode potential between the polycrystalline diamond and a reference electrode substantially constant while applying a current between the volume of the polycrystalline diamond and the counter electrode.

In an embodiment, a method of treating a cutter element comprising: contacting a volume of polycrystalline diamond with an electrolyte solution, and galvanostatically corroding at least a portion of the catalyst material from the interstitial spaces between the diamond grains in the volume of polycrystalline diamond. The volume of the polycrystalline diamond comprises interbonded diamond grains and a catalyst material disposed in at least some of the interstitial spaces between adjacent diamond grains. Galvanostatically corroding at least the portion of the catalyst material from the interstitial spaces comprises maintaining a substantially constant current density between the polycrystalline diamond and a counter electrode.

In an embodiment, a system for treating a cutter element comprises an electrolyte solution, a counter electrode in electrical contact with the electrolyte solution, a volume of polycrystalline diamond in electrical contact with the electrolyte solution, and a power source electrically coupled to the counter electrode and the volume of the polycrystalline diamond. The volume of the polycrystalline diamond comprises interbonded diamond grains and a catalyst material disposed in at least some of the interstitial spaces between adjacent diamond grains in the volume of polycrystalline diamond. The power source is configured to supply an electrical current to maintain a predetermined electrochemical potential between a reference electrode and the volume of polycrystalline diamond to form a corrosion product from the catalyst material, and the corrosion product is soluble in the electrolyte solution.

In an embodiment, a method of treating a cutter element comprises contacting at least a portion of a volume of polycrystalline diamond with an electrolyte solution, applying an electrical current between the volume of the polycrystalline diamond and a counter electrode that is in contact with the electrolyte solution, circulating the electrolyte solution during the applying of the electrical current, and corroding at least a portion of the catalyst material from the interstitial spaces between the diamond grains in the volume of polycrystalline diamond. The volume of the polycrystalline diamond comprises interbonded diamond grains and a catalyst material disposed in the interstitial spaces between adjacent diamond grains in the volume of polycrystalline diamond.

In an embodiment, a system for treating a cutter element comprises an electrolyte solution, a counter electrode in electrical contact with the electrolyte solution, a volume of polycrystalline diamond in electrical contact with the electrolyte solution, a circulation system configured to circulate the electrolyte solution in contact with the volume of polycrystalline diamond, and a power source electrically coupled to the counter electrode and the volume of the polycrystalline diamond. The volume of the polycrystalline diamond comprises interbonded diamond grains and a catalyst material disposed in the interstitial spaces between adjacent diamond grains in the volume of polycrystalline diamond. The power source is configured to supply an electrical current between the counter electrode and the volume of polycrystalline diamond to form a corrosion product from the catalyst material, and the corrosion product is soluble in the electrolyte solution. The circulation system can be used alone or in combination with the potentiostatic and/or galvanostatic corrosion of the metal.

In an embodiment, a method of treating a cutter element comprises contacting at least a portion of a volume of polycrystalline diamond with an electrolyte solution, applying an electrical current between the volume of the polycrystalline diamond and a counter electrode that is in contact with the electrolyte solution to maintain a predetermined electrochemical potential between a reference electrode and the volume of polycrystalline diamond, forming a corrosion product comprising an iodide salt of the catalyst material, and removing the iodide salt from the interstitial spaces between the diamond grains in the volume of polycrystalline diamond. The volume of the polycrystalline diamond comprises interbonded diamond grains and a catalyst material disposed in the interstitial spaces between adjacent diamond grains in the volume of polycrystalline diamond. The electrolyte solution comprises an aqueous solution comprising iodide ions, and the iodide salt is soluble in the electrolyte solution.

In an embodiment, a system for treating a cutter element comprises an electrolyte solution, a counter electrode in electrical contact with the electrolyte solution, a volume of polycrystalline diamond in electrical contact with the electrolyte solution, and a power source electrically coupled to the counter electrode and the volume of the polycrystalline diamond. The electrolyte solution comprises an aqueous solution comprising iodide ions. The volume of the polycrystalline diamond comprises interbonded diamond grains and a catalyst material disposed in the interstitial spaces between adjacent diamond grains in the volume of polycrystalline diamond. The power source is configured to supply an electrical current between the counter electrode and the volume of polycrystalline diamond to maintain a predetermined electrochemical potential between a reference electrode and the volume of polycrystalline diamond to form a corrosion product from the catalyst material. The corrosion product comprises an iodide salt of the catalyst material, and the corrosion product is soluble in the electrolyte solution.

In an embodiment, a method of treating a cutter element comprises determining a correlation between an amount of catalyst material corroded from a volume of polycrystalline diamond and an amount of electrical charge transferred between the volume of the polycrystalline diamond and a counter electrode, contacting at least a portion of the volume of polycrystalline diamond with an electrolyte solution, applying an electrical current between the volume of the polycrystalline diamond and the counter electrode to maintain a predetermined electrochemical potential between a reference electrode and the volume of polycrystalline diamond corroding at least a portion of the catalyst material from the interstitial spaces between the diamond grains in the volume of polycrystalline diamond based on the contacting and the applying, determining the amount of electrical charge transferred between the volume of the polycrystalline diamond and the counter electrode based on the determining of the electrical current applied over time, and ceasing the application of the electrical current when the amount of electrical charge transferred between the volume of the polycrystalline diamond and the counter electrode reaches or exceeds a threshold. The volume of the polycrystalline diamond comprises interbonded diamond grains and the catalyst material disposed in the interstitial spaces between adjacent diamond grains in the volume of polycrystalline diamond. The counter electrode is in contact with the electrolyte solution, and a depth of the catalyst material corroded from the volume of polycrystalline diamond meets or exceeds a predetermined removal depth.

In an embodiment, a method of treating a cutter element comprises performing a potentiodynamic scan of a metal in an electrolyte solution, identifying an operating electrode potential within a region of increased current density identified by the potentiodynamic scan, applying an electrical current between a volume of polycrystalline diamond and a counter electrode in an electrochemical cell to maintain a predetermined electrochemical potential between a reference electrode and the volume of polycrystalline diamond, and corroding at least a portion of the metal from the interstitial spaces between the diamond grains in the volume of polycrystalline diamond in response to applying the electrical current. The volume of the polycrystalline diamond comprises interbonded diamond grains and a catalyst material disposed in interstitial spaces between adjacent diamond grains in the volume of polycrystalline diamond. The catalyst material comprises the metal, and the electrical current is supplied at the operating electrode potential.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description.

DETAILED DESCRIPTION

Figure 1A:
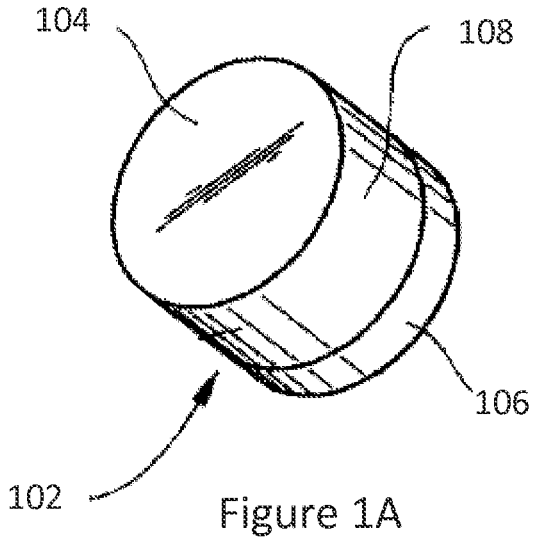
FIG. 1A is a perspective view of a PCD cutter element according to an embodiment.

In the drawings and description that follow, like parts are typically marked throughout the specification and drawings with the same reference numerals, respectively. The drawing figures are not necessarily to scale. Certain features of the disclosed embodiments may be shown exaggerated in scale or in somewhat schematic form, and some details of conventional elements may not be shown in the interest of clarity and conciseness. Unless otherwise specified, any use of any form of the terms "connect," "engage," "couple," "attach," or any other term describing an interaction between elements is not meant to limit the interaction to direct interaction between the elements and may also include indirect interaction between the elements described. In this way, a first device or component may be indirectly "connected," "engaged," "coupled," "attached," etc. to a second device or component when they are connected via other intermediate devices, components, and connections that are disposed there between. In the following discussion and in the claims, the terms "including" and "comprising" are used in an open-ended fashion, and mean "including, but not limited to . . . ."

Disclosed herein are systems and methods used to corrode at least a portion of the catalyst material from the interstices of a PCD element after its formation. Specifically, the disclosed systems and methods utilize electrochemical corrosion techniques to accelerate the corrosion of the catalyst material in the PCD element, thereby removing at least a portion of the catalyst material from the PCD element.

As described in more detail below, the electrochemical corrosion of the catalyst material may be carried out by applying a current between the PCD element, which acts as a working electrode, and a counter electrode within a liquid electrolyte solution at a constant or near constant working electrode potential measured against a reference electrode. As used herein, "corrode," "corrosion," and/or "corroding" generally refers to the electrochemical oxidation of a metal in a chemical reaction to produce an oxide(s) and/or salt(s) of the metal. The corrosion product may be removed from the PCD element and may be soluble in the electrolyte solution in contact with the PCD element. The application of electrical current during the corrosion of the catalyst material may increase the removal rate of the catalyst material from the PCD element. The use of a preselected electrode potential that is constant or near constant may allow the current to be applied at an electrode potential selected to provide an increased corrosion rate for the catalyst material. The working electrode potential may be measured relative to a reference electrode placed in the system that is also in contact with the liquid electrolyte solution. The current can be adjusted during the catalyst material removal process to maintain the electrochemical potential of the working electrode at the preselected value throughout the removal process.

In addition to using the electrical current, the liquid electrolyte may flow relative to the PCD element during the catalyst material removal process so that the electrolyte flows over the surface of the PCD element. The flow may increase the diffusion rate of the reactants in the electrolyte solution to the catalyst material surface as well as increase the diffusion rate of the resulting corrosion products away from the catalyst material surface. This may increase the overall catalyst material removal rate as is highly desirable and is accomplished with the use of the systems and methods described herein.

Figure 1B:
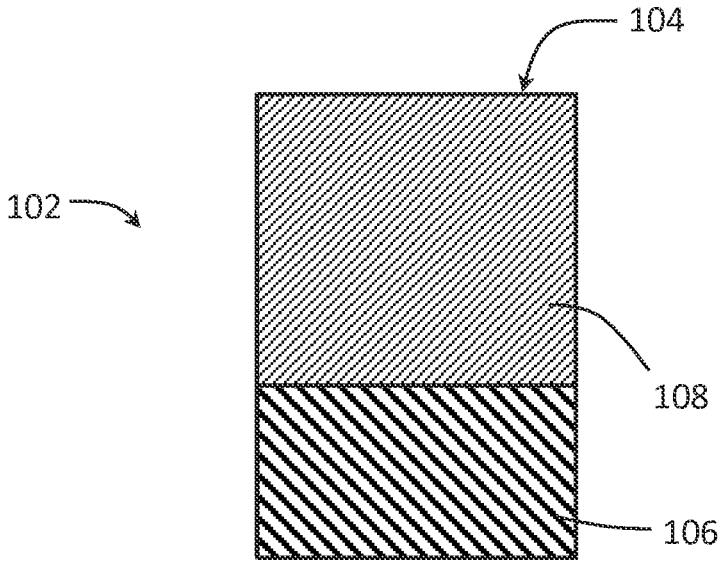
FIG. 1B is a cross-section view of the PCD element of FIG. 1A.

FIGS. 1A and 1B show a perspective and a cross-sectional view, respectively, of a PCD element 102 having a body or facing table 108 of polycrystalline diamond that is optionally bonded to a support or substrate 106 of less hard material, such as tungsten carbide with a cobalt binder material. The body 108 can vary in thickness and may generally be between about one thousandths of an inch to about two tenths of an inch thick. However, the thickness of the body 108 can vary depending upon the application in which the PCD element 102 is to be used. Although the PCD element 102 formed from polycrystalline diamond is described in an embodiment, other types of materials such as polycrystalline boron nitride ("PCBN") compacts, may also be used in alternative types of elements.

As described in more detail here, the body 108 can comprise a plurality of partially bonded superhard, diamond or diamond-like, crystals, a catalyst material, and an interstitial matrix formed by the interstices among the crystals. The PCD element 102 has one or more working surfaces 104 with the diamond crystals and the interstices forming the volume of the body 108 of the PCD element 102. The working surface 104 can include any portion of the PCD element 102 that may contact an object to be worked (e.g., rock or other formation material contacted by the PCD element, a machined component, etc.). As used herein, it should be understood that the use of the term "working surface" applies to any portion of PCD element 102 which may be exposed and/or used as a working surface. Further-more, any portion of any of the working surface 104 is, in and of itself, a working surface.

In an embodiment, the body 108 can be coupled to the substrate 106 using a high pressure and high temperature ("HPHT") press. However, other methods can be used to couple the body 108 to the substrate 106. In some embodiments, upon coupling the body 108 to the substrate 106, the working surface 104 of the PCD element 102 can be substantially parallel to the bonding surface between the body 108 and the substrate 106. As illustrated in FIG. 1, the PCD element 102 has been illustrated as having a right circular cylindrical shape. However, the PCD element 102 can be shaped into any shape that is appropriate for the PCD element's 102 intended use. In some embodiments, the top working surface 104 is substantially planar. However, the top working surface 104 can also be non-planar in some embodiments. For example, top working surface or any portion thereof (e.g., the outer perimeter of the working surface 104, etc.) can be beveled, curved, grooved, tapered, or otherwise shaped.

The PCD element 102 can be formed using any of a number of processes. In an embodiment, the PCD element 102 can be formed by independently forming the body 108 and the substrate 106, and then bonding the body 108 to the substrate 106. In some embodiments, the substrate 106 can be initially formed. The body 108 can be subsequently formed on a top surface of the substrate 106 by placing polycrystalline diamond powder with or without any catalyst material onto the top surface and subjecting the polycrystalline diamond powder and the substrate 106 to a HPHT process. The catalyst material (e.g., cobalt) can flow into the diamond powder during the HPHT process to catalyze the formation of the diamond-diamond bonds to create the body 108. In still other embodiments, the substrate 106 and the body 108 can be formed and bonded together at about the same time. Although several methods for forming the PCD element 102 have been briefly described, other methods known to those of ordinary skill in the art can also be used.

Various catalyst materials can be used in the formation process. In an embodiment, the catalyst material comprises cobalt, which can be used as the binder material for forming the substrate 106 and also as the catalyst material for diamond synthesis. While the catalyst material is described as comprising cobalt herein, alternative metals, such as iron, nickel, chromium, manganese, and tantalum, alloys thereof, and other suitable materials, can also be used as a catalyst for diamond synthesis. When using alternative materials as a catalyst for diamond synthesis to form the body 108, cobalt, or some other material such as nickel chrome or iron, can be used as the binder material for cementing the tungsten carbide or other material to form the substrate 106. Although some materials, such as tungsten carbide and cobalt, have been provided as examples, other materials known to those of ordinary skill in the art can be used to form the substrate 106, the body 108, and/or bonds between the substrate 106 and the body 108.

Figure 2:
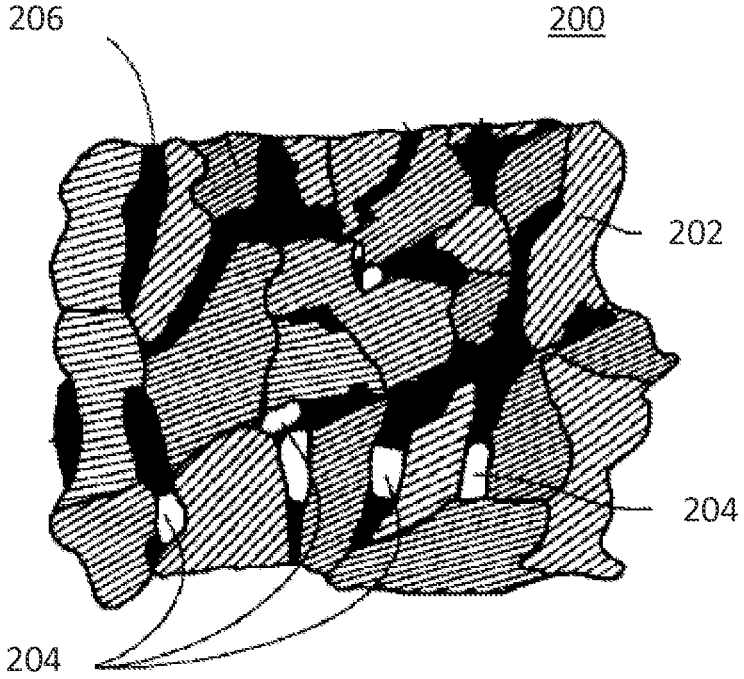
FIG. 2 is a close-up cross-sectional view of a PCD table according to an embodiment.

However the PCD element 102 is formed, the resulting microstructure generally comprises a plurality of partially bonded superhard, diamond or diamond-like, crystals, an interstitial matrix formed by the interstices among the diamond crystals and the catalyst material disposed within at least some of the interstices of the interstitial matrix. FIG. 2 schematically illustrates such a microstructure 200. Referring to FIGS. 1 and 2, the body 108 has diamond particles 202 bonded to other diamond particles 202, one or more interstitial spaces 204 formed between the diamond particles 202, and the catalyst material 206 deposited within the interstitial spaces 204. During the HPHT process, the interstitial spaces 204, or voids, are formed between the carbon-carbon bonds and are located between the diamond particles 202. The diffusion of the catalyst material 206 throughout the diamond powder during the sintering process results in the catalyst material 206 being deposited within some or all of these interstitial spaces 204. The HPHT process may result in some areas where the diamond to diamond growth encapsulates some of the binder-catalyst material. These encapsulated areas are not generally considered to be a part of the continuous interstitial matrix of the catalyst material. As initially formed, the PCD element 102 may comprise 85% to 95% by volume diamond with the catalyst material accounting for the remaining 5% to 15% by volume.

As noted above, the presence of the catalyst material within the interstitial spaces 204 may result in the thermal degradation of the body 108 at temperatures starting at about 400° C. In order to limit the thermal degradation, at least a portion of the catalyst material may be corroded and/or removed from the interstitial spaces within the PCD body 108. In general, the methods and systems described herein allow for the removal of a portion of the catalyst material from the PCD body 108 using electrochemical corrosion, fluid agitation, and or certain electrolyte solution chemistries.

Figures 3A, 3B:
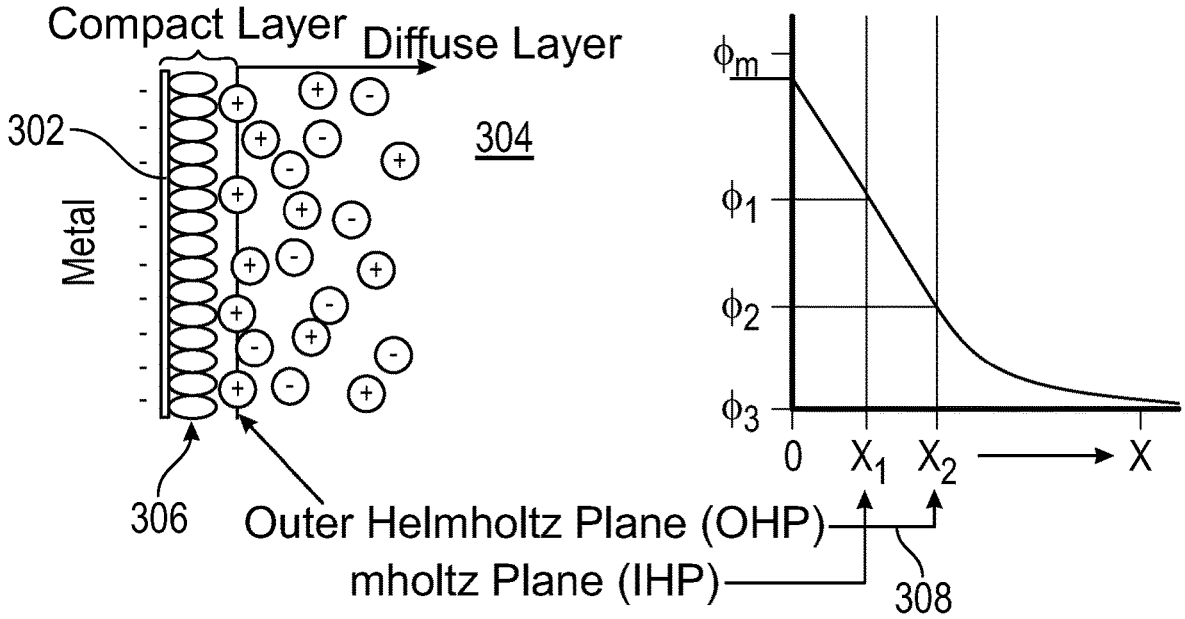
FIGS. 3A and 3B are schematic views of an electric double layer of charged molecules adjacent a metal surface and a corresponding potential profile, respectively, in an embodiment.

While not intending to be limited by this or any theory, it is believed that an analysis of corrosion principles can be used to improve the catalyst material removal process. To begin, FIG. 3A illustrates a schematic representation of a metal surface 302 in contact with an electrolyte solution 304. When the metal contacts the solution 304, one or more components within the electrolyte solution may begin to react with the metal, thereby beginning an electron transfer across the metal-solution interface. As the charge transfer is established across the metal-solution interface, an electrochemical potential difference is established across the interface. The potential difference established a double layer within the solution at the interface that has electrical, compositional, and structural characteristics. Structurally and compositionally, a first layer of molecules adsorb onto the metal surface due to the chemical interactions. A second layer includes ions attached to the surface charge generated by the first layer's interactions with the metal surface. The second layer is more loosely associated with the metal surface than the first layer. With respect to the electrical characteristics, excess charge develops on both the metal surface and within the first layer of molecules adjacent the metal surface within the solution. The resulting electrochemical potential across the interface is schematically illustrated in FIG. 3B. As can be seen, the potential difference across the interface changes and reduces to a free solution potential away from the interface.

The electrochemical potential established across the metal-solution interface occurs due to the reaction of the metal, or a component within the metal, and the species within the electrolyte solution. The reaction can be understood by the schematic illustration shown in FIG. 4 that illustrates a corrosion reaction at a metal surface in contact with an electrolyte solution to produce a free-corrosion potential. When a metal surface, which may not be in an electrical circuit (e.g., simply a metal element in contact with an electrolyte solution in a container), is in contact with the solution, the metal undergoes both anodic and cathodic reactions (e.g., collectively corrosion reactions). In the anodic reaction, the metal oxidizes to form metal cations while releasing electrons. In the cathodic reaction, the electrons pass through the interface and are taken up by cations within the electrolyte solution. For example, the electrons can be taken up in the cathodic reaction by hydrogen ions to form hydrogen gas, though the specific cathodic reaction products will vary based on the composition and pH of the electrolyte solution and metal surface as well as the free-corrosion potential of the metal-electrolyte solution system. The reactions are balanced in their reaction rates, with the slowest reaction rate limiting the overall reaction rate.

Figure 4:
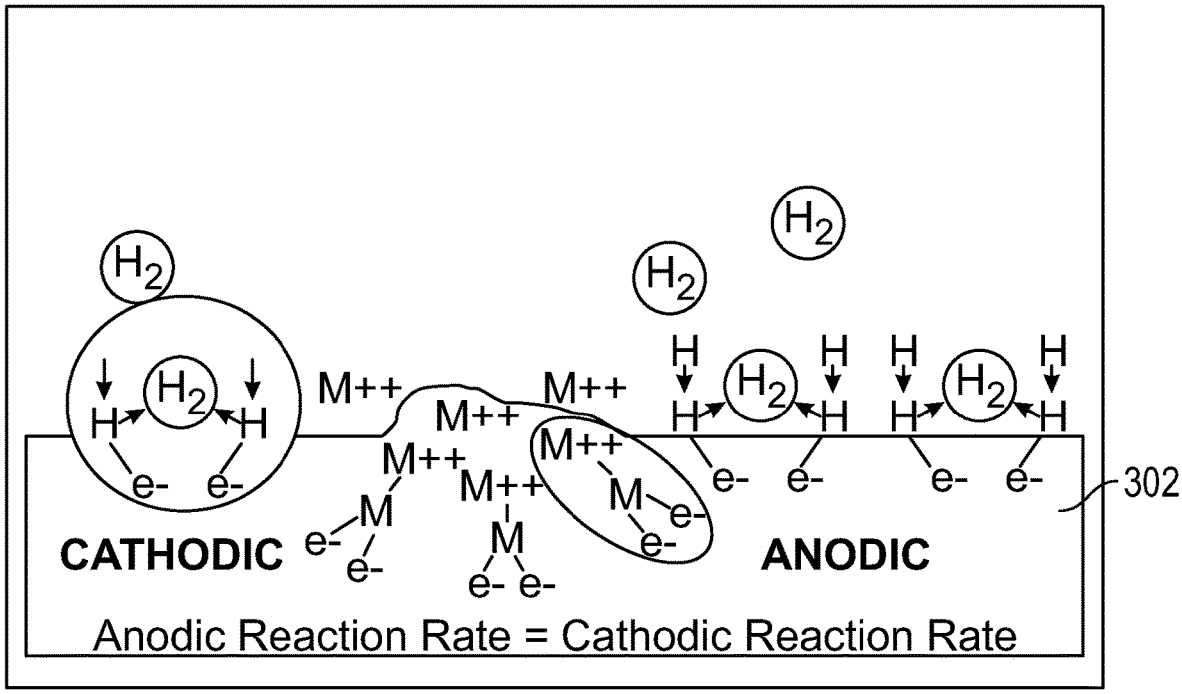
FIG. 4 is a schematic view of the reactions occurring at a metal-electrolyte interface according to an embodiment.

As also illustrated in FIG. 4, the mass transfer of the reactants and products also affects the reaction rate. The metal ions formed at the interface diffuse away from the metal-solution interface into the solution. At the same time, the counterions must diffuse to the metal-solution interface to take up the electrons. The diffusion of the various species represents a potential reaction rate limitation based on the mass transfer characteristics of the system.

The electrochemical potential across the metal-electrolyte solution interface exists in the absence of any electrical current flow. In order to determine the resulting electrochemical potential, a reference electrode can be used to determine the relative electrode potential. A reference electrode is any electrode used to measure the relative potentials of other electrodes, including the metal surface in contact with the electrolyte solution as described above. In general, a reference electrode has a stable and well-known electrode potential. Reference electrodes are generally non-reactive with respect to the species in the electrolyte solution, which can occur due to the selection of a non-reactive electrode material (e.g., platinum, palladium, or other noble metal) or the use of a barrier such as a porous membrane or material. The use of a barrier may prevent the reference electrode from directly contacting and reacting with the electrolyte solution while being in electrical contact with the solution. Various types of reference electrodes can be used including, but not limited to, a standard hydrogen electrode, a normal hydrogen electrode, a reversible hydrogen electrode, a saturated calomel electrode, a copper-copper(II) sulfate electrode, a silver chloride electrode, silver-silver iodide electrode, a palladium-hydrogen electrode, any electrode formed of an inert metal (e.g., a noble metal), or any combination thereof. While reference is made to a saturated calomel electrode (SCE) herein, other types of reference electrodes can be used with adjustments made for the specific standards and electrode potentials of each type of electrode. Further, the annotation of an electrochemical potential as being relative to a reference electrode (e.g., relative to (SCE)) indicates the relative electrochemical potential of the electrode relative to the electrode potential of reference electrode.

In order to increase the corrosion rate of the metal in the metal surface, one or more of the rate limiting aspects of the reaction can be changed. In an embodiment, the anodic and cathodic reaction rates can be increased. This may occur with or without an increase in the mass transfer rate of the species to and from the metal-solution interface. In an embodiment, electrochemical corrosion can be used to increase the reaction rate by taking up electrons to increase the anodic and cathodic reaction rates. Electrochemical corrosion can be carried out by forming an electrochemical cell in which the metal surface forms the working electrode that is in electrical communication with a counter electrode through the electrolyte solution. As used herein, an "electrochemical cell" refers to a system comprising an anode and a cathode, both of which are in contact with an electrolyte solution to create an electrical circuit. The use of the electrochemical cell allows the electrons to be taken up within the metal and applied at a counter-electrode that is also in contact with the electrolyte solution. In this configuration, the anodic reaction rate is increased at the metal surface. The cathodic reaction rate is increased by allowing all or a portion of the cathodic reaction to occur at the counter electrode. Thus, the electrochemical cell can increase the corrosion rate of the metal.

When an electrochemical cell is created, a current may pass between electrodes within the cell by applying an electrical voltage across the electrodes. However, the electrical voltage applied across the electrodes is not the same as the electrode potential of the working electrode in the solution. This is due to the combined effects of the applied voltage along with the electrochemical potentials present at the electrode surface-solution interface. As used herein, the term "electrode potential" refers to the potential of an electrode as measured relative to a reference electrode. The electrode potential is generally not the same as the voltage applied across the electrochemical cell at the power supply. As used herein, the term "working electrode potential" refers to the potential of the working electrode relative to a reference electrode.

Figure 5:
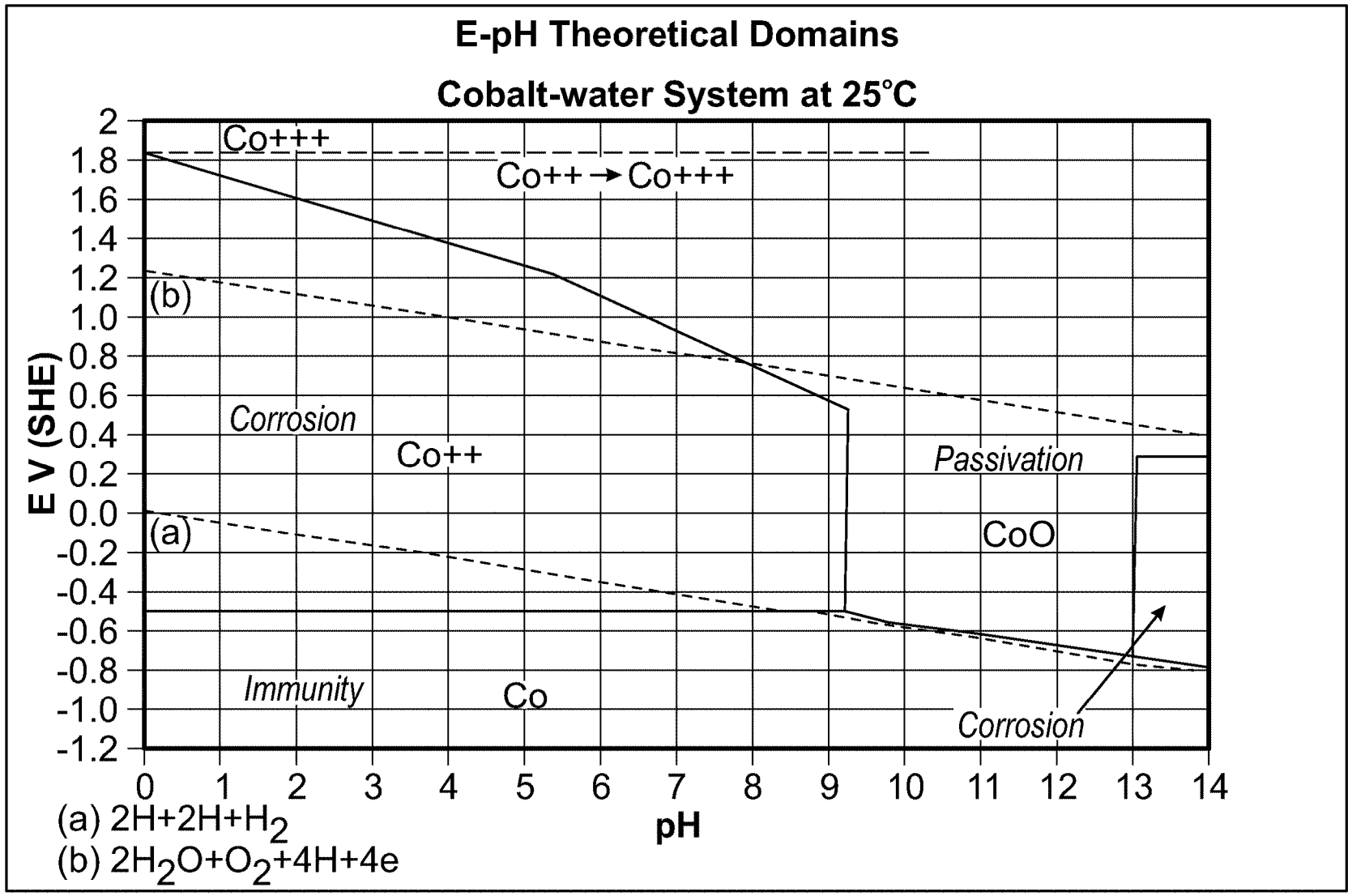
FIG. 5 is an exemplary potential-pH diagram of a cobalt and water system.

While an electrochemical cell can be used to perform electrochemical corrosion and increase the corrosion rate, simply applying current across the working and counter electrodes may not increase the corrosion rate. Rather, consideration of the electrode potential, the metal composition, the electrolyte solution composition and properties can be used to determine the appropriate conditions under which the electrochemical cell should be operated. FIG. 5 illustrates a potential pH diagram that illustrates the electrochemistry of cobalt. The diagram illustrates the regions in which cobalt will corrode under specific electrode potentials (e.g., relative to a Standard Hydrogen Electrode (SHE)) over the illustrated pH range. As can be seen, various reaction envelopes are present. A lower region in the diagram demonstrates the conditions under which cobalt is immune from corrosion. The electrode potential in this region is sufficient to reduce any cobalt cations present to metallic cobalt, thereby plating any cobalt onto the metal surface rather than oxidizing the cobalt into the solution. As the electrode potential increases above around −0.5 V (SHE), the cobalt enters a corrosion envelope at a pH ranging from about 0 to about 9.1 and from a pH of about 13 to about 14. Within the corrosion envelope, metallic cobalt will form Co(II) in the anodic reaction. In the pH range of about 9.1 to about 13, cobalt will oxidize to form cobalt oxide, which is substantially non-soluble and forms a protective coating on the metal surface. This region is referred to as the passivation region since the cobalt oxide forms a protective coating that limits or prevents the removal of the cobalt surface for reaction. An upper region on the diagram represents a region in which cobalt forms Co(III). In general, several cobalt III compounds are relatively insoluble in an aqueous solution. This region is generally avoided to limit the formation of insoluble cobalt corrosion products, which can clog the diffusion pathways within the PCD element (e.g., clogging the interstitial spaces), thereby slowing the overall corrosion process. While FIG. 5 illustrates the electrochemistry of cobalt, the behavior of other metals can be represented by similar diagrams having similar "corrosion envelopes."

In an embodiment, the electrochemical corrosion described herein can be carried out within the corrosion envelope of the particular metal being corroded from the PCD element. For cobalt, the electrochemical cell may be operated at an electrode potential greater than about −0.5 V (SHE) and less than the upper corrosion envelope electrode potential, which will vary based on the pH of the electrolyte solution. In addition, the pH of the electrolyte solution may be selected to allow the electrochemical cell to operate within the corrosion envelope for the metal being corroded from the PCD element. For cobalt, the electrochemical cell may be operated at a pH between about 0 and about 9.1 or at a pH of from about 13 to about 14.

Figure 6:
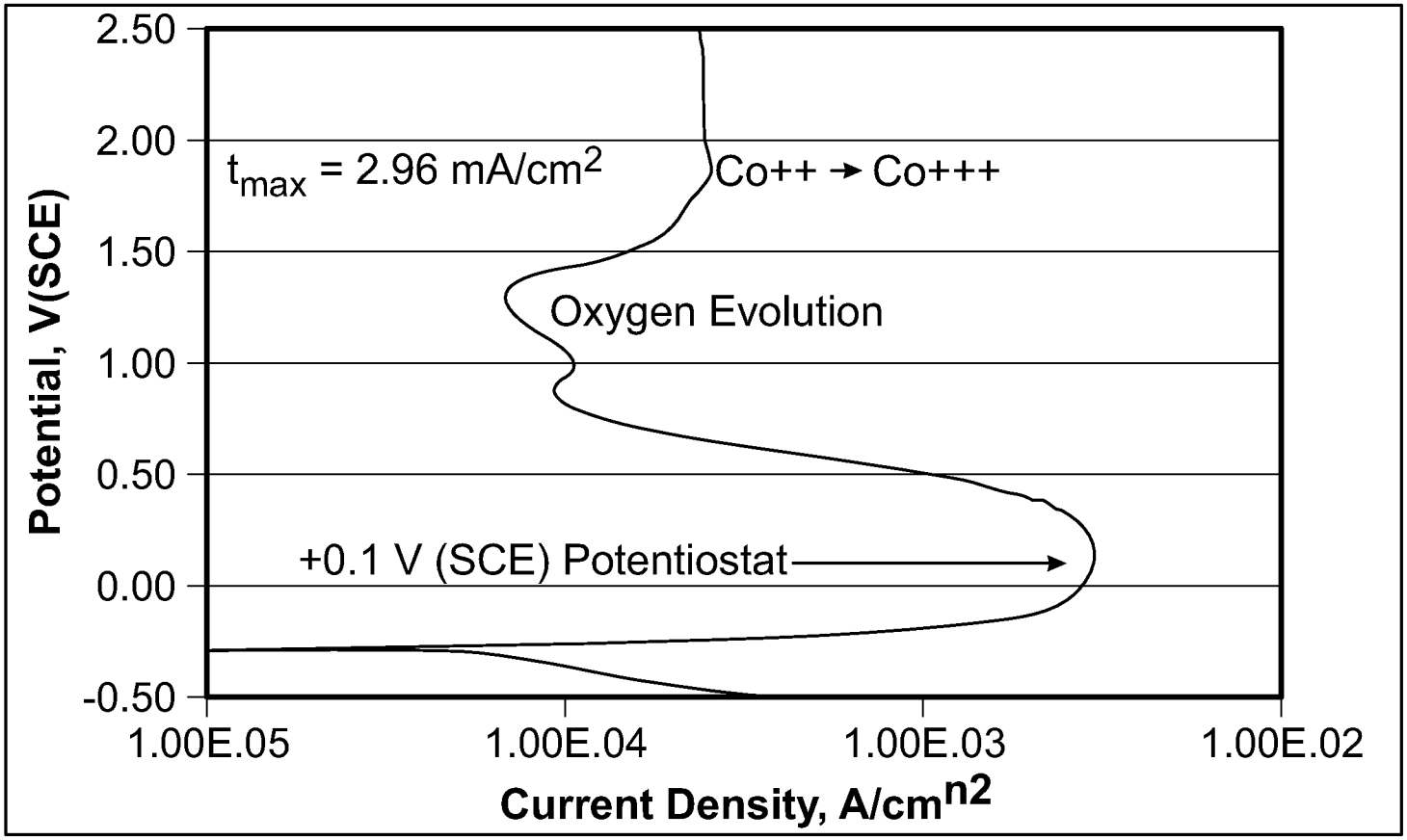
FIG. 6 is an exemplary potentiodynamic scan according to an embodiment.

The corrosion envelope provides an operating guideline in which the metal being corroded from the PCD element can be corroded, but does not provide an indication of the specific operating conditions or reaction rates within the electrochemical cell. In order to determine the operating conditions for an electrochemical cell, a potentiodynamic scan can be performed in an electrochemical cell in which the working electrode comprises cobalt and the counter electrode and a reference electrode are all in contact with an electrolyte solution. In an embodiment, a potentiodynamic scan involves varying the electrode potential of a working electrode with respect to a reference electrode at a selected rate while applying and measuring a current between the working and counter electrodes. In general, the potentiodynamic scan provides the current flow rate, which can be normalized based on the area of the working electrode to provide the current density, over a range of electrode potentials. An exemplary potentiodynamic scan is illustrated in FIG. 6. While some of the features illustrated in FIG. 6 may change based on the catalyst material, the electrolyte solution composition, and/or the conditions and properties of the system, the main features of the potentiodynamic scan are generally represented in the scan of FIG. 6. As can be seen, the current density changes over the selected electrode potential range. In general, a region of increased current density occurs above the reduction potential. As used herein, the region of increased current density includes the range of current densities and corresponding electrode potentials that are within about 10% of the maximum or peak current density measured in the potentiodynamic scan. As the electrode potential increases above the peak region, the current density generally decreases. Since the current density is related to the rate of oxidation of the metal being corroded from the PCD element, the electrochemical cell may be operated at or near the current density peak region to provide the highest metal corrosion rate.

The exemplary potentiodynamic scan illustrated in FIG. 6 also demonstrates that an increased metal corrosion rate can be achieved by operating under potentiostatic electrochemical corrosion conditions. As used herein, "potentiostatic" refers to the operation of an electrochemical cell where an electrode is maintained at a constant or substantially constant potential with respect to a reference electrode in an electrolyte solution. While the electrode potential may be maintained at a constant or substantially constant value, the current applied to the electrochemical cell may vary over time based on various factors. In an embodiment, the electrochemical cells described herein may be operated at a constant or near constant electrode potential. In order to operate under these conditions, the electrode potential measured between the working electrode and the reference electrode may be maintained at a constant or near constant potential by varying the current between the working and counter electrodes. By operating within the corrosion envelope and/or operating at a constant electrode potential, the rate of metal corrosion from the PCD element can be improved relative to standard acid based leaching or other electrochemical corrosion conditions.

Figure 7:
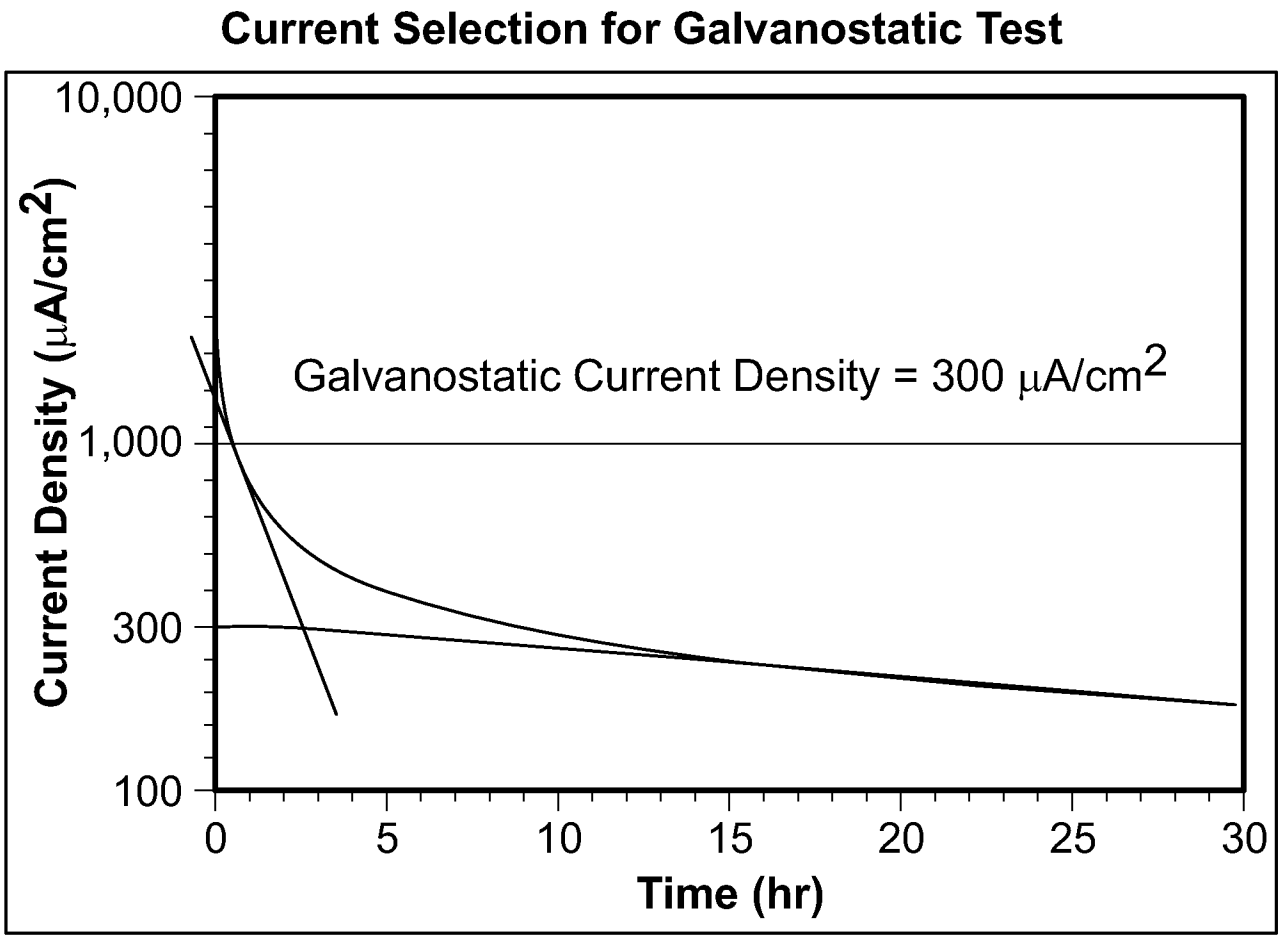
FIG. 7 is an exemplary potentiostatic current-time curve according to an embodiment.

FIG. 7 illustrates an exemplary potentiostatic current-time curve demonstrating the current density over time during an electrochemical corrosion process. As illustrated in FIG. 7, the initial current density is relatively high and then rapidly drops off as the surface metal is corroded and transferred to the electrolyte solution. After the initial drop off period, the current density continues to decrease at a slow rate during the remainder of the electrochemical corrosion process.

In some embodiments, an increased metal corrosion rate can be achieved by operating under galvanostatic electrochemical corrosion conditions. As used herein, "galvanostatic" refers to the operation of an electrochemical cell where a current density between the working electrode and the counter electrode is maintained at a constant or near constant value. Galvanostatic operation of the electrochemical corrosion process can also refer to maintaining a constant or near constant electrical current between the working electrode and the counter electrode. In an embodiment, the electrochemical cells described herein may be operated at a constant or near constant current density. The working electrode potential may be varied in the galvanostatic operation of the electrochemical cell to maintain the current density at or near a constant value. By operating within the corrosion envelope and/or operating at a constant or near constant current density, the rate of metal corrosion from the PCD element can be improved relative to standard acid based leaching or other electrochemical corrosion conditions.

The value of the current density can be selected using the potentiostatic current-time curve as described above with respect to FIG. 7. In an embodiment, a potentiostatic current-time curve can be generated for a selected catalyst material and electrolyte solution. The current density for use in the galvanostatic operation of the electrochemical cell can then be selected as the current density after the initial rapid decrease in the current density. In an embodiment, the value of the current density can be selected as the current density based on the slope of the current density decrease after the initial current density reduction period. As shown in FIG. 7, the current density may fall off in a linear fashion after an initial period, which may include the first five to fifteen hours. Within this linear or near linear drop off portion of the current density-time curve, a line may be fitted to the current density reduction. The value of the current density used with the galvanostatic electrochemical corrosion process may then be selected as the value of the current density at the intercept of the fitted line with the beginning of the corrosion process (i.e., at time zero). As shown in FIG. 7, this may represent approximately 300 $\mu A/cm^2$ in the illustrated example. In some embodiment, the value of the current density can be selected when the current density as measured in the potentiostatic current-time curve changes by less than about 10%, less than about 7.5%, less than about 5%, or less than about 2.5% per hour. Once the current density is selected for operation of the electrochemical cell, the electrochemical corrosion process may be carried out while maintaining the current density at a constant or near constant value. In use, the potentiodynamic scan may be used in the PCD element formation process. In an embodiment, a potentiodynamic scan of a selected metal and/or combination of metals (e.g., an alloy, composite, etc.) may be performed in a selected electrolyte solution. The scan may be performed under selected operating conditions of temperature and pressure. In some embodiments, a corrosion envelope may be identified for the metal or combination of metals within the catalyst material to select the conditions under which the potentiodynamic scan is performed. The potentiodynamic scan may be used to identify a peak current density and/or a wider region of increased current density.

Using the identified peak or region of increased current density, an operating electrode potential may be identified. The operating electrode potential may then be used to operate an electrochemical cell containing an electrolyte solution having the same or substantially the same composition as the electrolyte solution used in the potentiodynamic scan. The electrochemical cell may be operated with a PCD element having a catalyst material disposed in interstitial spaces between adjacent diamond grains as the working electrode. The catalyst material may be the metal studied or at least contain the metal studied in the potentiodynamic scan. The electrochemical cell can then be used to corrode at least a portion of the metal from the PCD element at the operating electrode potential.

In an embodiment, the reaction rate of the corrosion reaction may also be increased by increasing the mass diffusion rate between the metal-electrolyte solution interface and the bulk fluid. In order to increase the mass transfer rate, the surface turbulence of the electrolyte solution in contact with the metal can be increased. The localized turbulence may induce bulk fluid movement near the surface, which may decrease the boundary layer through which the reaction species must diffuse to and from the interface. The surface turbulence can be created by circulating the fluid in contact with the interface. In an embodiment, a bulk flow rate may be induced past the metal-electrolyte solution interface. As described in more detail below, the bulk flow can be inducted through the use of a stirring element within a reactor and/or through the use of a bulk fluid circulation system through a reaction cell. The increase in the surface turbulence is effective with or without the use of electrochemical corrosion and/or with or without the potentiostatic and/or galvanostatic application of current during operation of the electrochemical cell.

Figure 8:
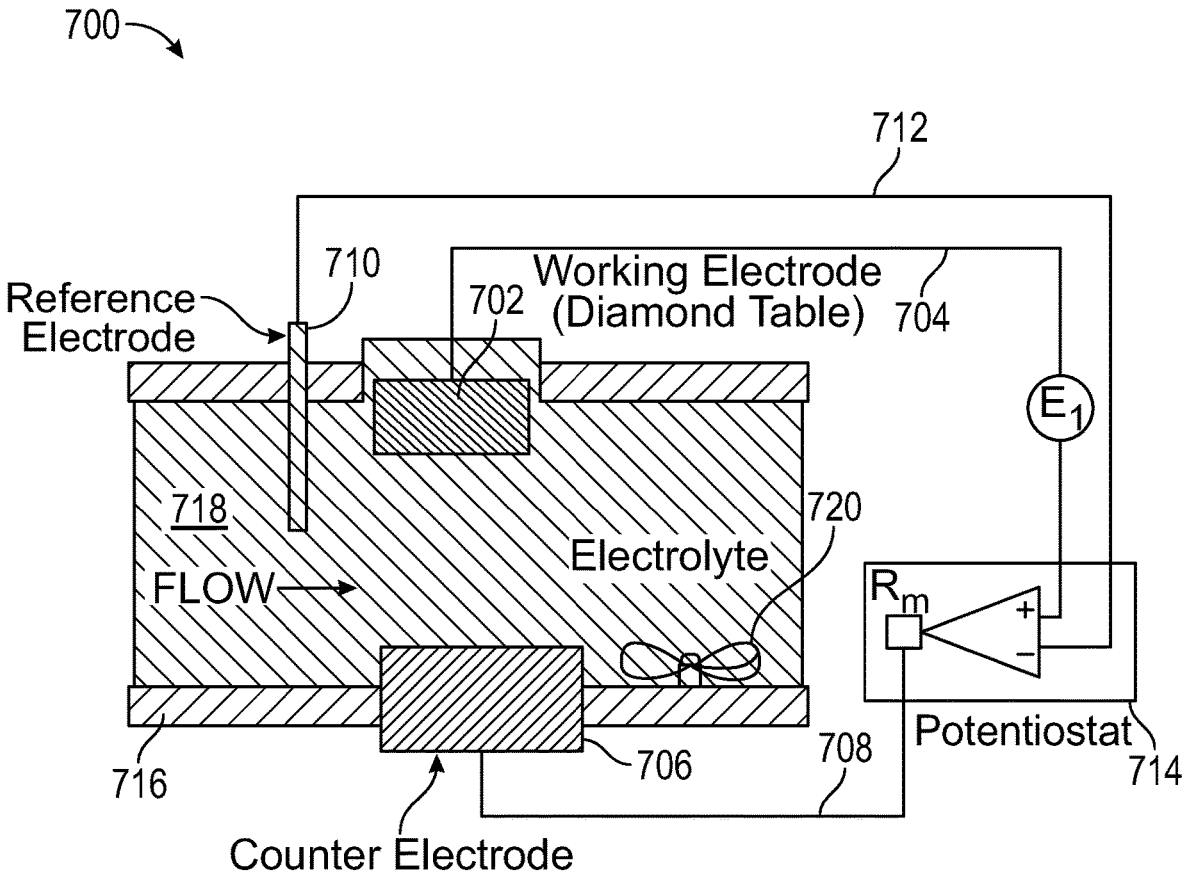
FIG. 8 is a schematic layout of an electrochemical cell according to an embodiment.

The principles and techniques described herein can be applied in a number of ways and in various combinations. While embodiments of electrochemical cells are described herein, the principles and methods described above can be applied to any number of electrochemical cell configurations. FIG. 8 illustrates a schematic view of an embodiment of an electrochemical cell 700. The electrochemical cell 700 can be used to corrode a catalyst material from a PCD element 702. Referring to FIG. 8, the electrochemical cell 700 comprises a container or housing 716 containing the PCD element 702 acting as the working electrode, which is electrically coupled to a power source 714 through an electrical connection 704. As used herein, "electrical connection" means any conductor or other means by which current may be conducted from one component to another. The electrochemical cell 700 also comprises a counter electrode 706 that is electrically coupled to the power source 714 through an electrical connection 708. A reference electrode 710 is also disposed within the electrochemical cell 700 and is electrically coupled to the power source 714 through an electrical connection 712. An electrolyte solution 718 is disposed within the housing and contacts the reference electrode 710, the working electrode 702, and the counter electrode 706.

The housing 716 functions to contain the electrolyte solution and maintain the electrodes in position during operation of the electrochemical cell 700. The housing 716 can generally have any shape, and in an embodiment, may have a rectilinear or cylindrical configuration. The housing 716 may be formed from any non-reactive material such as glass, ceramic, plastic, resin, non-reactive metals, or the like, though some embodiments, a reactive material may be used to form the housing so long as a non-reactive barrier is placed between the reactive material and the electrolyte solution. In some embodiments, the housing 716 may have a coating on the inner surface to limit any reactions with the electrolyte solution. For example, the interior surface may be coated with a fluorocarbon such as polytetrafluoroethylene.

The electrolyte solution 718 is placed within the housing 716 and filled to a depth sufficient to contact the working electrode 702, the counter electrode 706, and the reference electrode 710. The electrolyte solution 718 is a liquid solution that is able to react with the catalyst material, for example cobalt, in the presence of an electrical current. The electrolyte solution 718 can comprise any compounds that provide for a soluble corrosion product when the catalyst material reacts with the components of the electrolyte solution. In an embodiment, the electrolyte solution comprises an aqueous solution comprising a dilute mineral acid, an organic acid, a component providing a halide ion, or any combination thereof. The electrolyte solution may also comprise one or more additives such as buffering agents, pH adjusting agents, salts, or the like. The use of electrochemical corrosion with the potentiostatic and/or galvanostatic application of current to corrode the catalyst material may allow for dilute concentrations of electrolytes to be used in the electrolyte solution, thereby providing a safe working environment while corroding the catalyst material. In an embodiment, the total concentration of the components within the electrolyte solution may have a normality (N) of less than about 1.5, less than about 1.25, less than about 1.0, less than about 0.9, less than about 0.8, less than about 0.7, less than about 0.6, less than about 0.5, less than about 0.4, less than about 0.3, less than about 0.2, or less than about 0.1. Thus, the electrolyte solution may be safer than common leaching processes that use concentrated mineral acids at elevated temperatures. While described as a dilute solution, the total concentration of the components within the electrolyte solution may have a normality (N) of greater than about 1.5 in some embodiments.

In an embodiment, the electrolyte solution may comprise a halide ion. The halide ion may be provided by using a hydrohalic acid including, but not limited to, hydrofluoric acid, hydrobromic acid, hydroiodic acid, hydrochloric acid, or any combination thereof. In some embodiment, the halide ion may be provided by a salt comprising a halide ion including, but not limited to a sodium, potassium, or organic salt of chlorine, iodine, and/or bromine. In an embodiment, the electrolyte solution comprises iodide ion, for example, as provided in the form of hydroiodic acid, sodium iodide, potassium iodide, or any other acid or salt of iodine. In this embodiment, the normality of the iodide ion can be less than about 1.0, less than about 0.9, less than about 0.8, less than about 0.7, less than about 0.6, less than about 0.5, less than about 0.4, less than about 0.3, less than about 0.2, or less than about 0.1. In an embodiment, the electrolyte solution may comprise about 0.1 N sodium iodide.

In an embodiment, the electrolyte solution may comprise a dilute or concentrated mineral acid. Suitable mineral acids can comprise, but are not limited to, nitric acid, hydrochloric acid, sulfuric acid, phosphoric acid, hydrofluoric acid, perchloric acid, and/or any combination thereof. In an embodiment, the electrolyte solution may comprise about 0.1 N hydrochloric acid, 0.5 N nitric acid, and/or about 0.1 N nitric acid. The electrolyte solution may comprise one or more organic acids or salts alone or in combination with any of the other components discussed. Suitable organic acids include, but are not limited to, carboxylic acids (e.g., acetic acid, etc.), sulfonic acid, salts thereof, and/or any combination thereof.

In some embodiments, optional additives may also be added to the electrolyte solution such as buffering agents, pH adjusting agents, salts, or the like. Buffering agents may be used to adjust and/or maintain the pH within a desired range during the use of the electrochemical cell. Similarly, salts may be used to adjust the ionic strength of the electrolyte solution. The pH adjusting agents may be used to obtain a desired pH level within the electrolyte solution during the electrochemical corrosion process. Examples of salts and buffering agents include acid salts (e.g., sodium bicarbonate, sodium hydrosulfide, sodium bisulfate, monosodium phosphate, monopotassium phosphate, etc.), sodium chloride, potassium chloride, sodium nitrate, potassium hydrogen phthalate, and any combination thereof. Suitable pH adjusting agents can include any acid or basic aqueous solution. Acid solutions can include any of those acids listed above as well as acid buffering agents and acid salts. Basic solutions can include, but are not limited to, potassium hydroxide, barium hydroxide, cesium hydroxide, sodium hydroxide, strontium hydroxide, calcium hydroxide, magnesium hydroxide, lithium hydroxide, rubidium hydroxide, and any combination thereof. Basic salts can also be used as salts and/or pH adjusting agents, and suitable basic salts can include, but are not limited to, calcium carbonate and sodium carbonate.

The electrodes are placed within the housing 716 so as to be in electrical contact with the electrolyte solution 718. The reference electrode can comprise any of the types of reference electrodes described above. In general, the reference electrode is placed within the housing 716 near the counter electrode 706. The reference electrode 710 is generally positioned to measure the potential between the reference electrode 710 and the counter electrode 706 without being positioned in the electric field between the working electrode 702 and the counter electrode 706. For example, the reference electrode may be placed near, but to the side of the counter electrode 706. This may avoid the reference electrode 710 detecting any corrosion products or other types of affects from the electric field interactions between the working and counter electrodes.

The working electrode may generally comprise a holder capable of retaining the PCD element and ensuring electrical communication between the electrical connection 704 and the PCD element. In an embodiment, the working electrode 702 may comprise only the PCD element coupled to the electrical connection 704. In some embodiments, a holder may be used to retain the PCD element and provide an electrical connection between the PCD element and the electrical connection 704. As noted above, the electrochemical cell 700 may be used to corrode the catalyst material (e.g., a metal such as cobalt) from a PCD element.

In some embodiments, the catalyst material may only be corroded from a portion of the PCD element, for example from a working surface of the PCD element or from some other volume that is less than the entire PCD element. Avoiding the corrosion of the catalyst material from some regions may be desirable. For example, the support may comprise cobalt that serves a binder, and the removal of the cobalt from the support may weaken the support and/or the bond between the support and the body. In order to corrode the catalyst material from a portion of the PCD element, a mask or coating may be used to prevent or limit contact between the electrolyte solution and the portion of the PCD element, which may prevent or limit the removal of the catalyst material in the covered areas. In an embodiment, the coating or mask may take the form of the holder used to retain the PCD element during the operation of the electrochemical cell 700. The holder may surround and mask at least a portion of the PCD element, for example allowing only a top working surface to be exposed. In some embodiments, a portion of the holder may also surround and mask a portion of the perimeter of the body of the PCD element on an outer edge, thereby exposing a portion of outer side wall. This may allow the top cutter surface and at least a portion of the outer side wall to be exposed to the electrolyte solution. The holder can be formed from a non-reactive material such as a polymeric component, a ceramic, or the like. In an embodiment, the holder may be formed from a pliable material and/or a seal may also be used to provide a sealing engagement between the holder and the PCD element. It will be appreciated that the mask may also be provided as a coating. In some embodiments, a coating may be applied to more than the desired area and a portion of the coating may be removed to expose the portion of the PCD element intended to contact the electrolyte solution.

The counter electrode 706 is positioned opposite the working electrode 702 within the housing 716. The counter electrode 706 can comprise any suitable shape. In general, charge concentration can be limited by preventing points such as corners or peaks on the surface of the electrodes. This may be accomplished by having a substantially round, oval, oblong, or other shaped counter electrode that is free of sharp corners or points. The surface of the counter electrode closest to the working electrode may be substantially flat or shaped to correspond to the working electrode. The top surface of the counter electrode nearest the working electrode may have a rounded, curved, or otherwise smoothed transition to the sides of the counter electrode. The material used to fabricate the counter electrode may generally be relatively corrosion resistant. In an embodiment, the counter electrode may be non-reactive with the electrolyte solution while being conductive. In an embodiment, the counter electrode can be formed from carbon (e.g., graphite), platinum, gold, palladium, precious metals, and the like. In some embodiments, the counter electrode can comprise the same metal as the catalyst material being corroded from the PCD element. When a sufficient electrode potential is applied, any of the catalyst material forming a soluble component within the electrolyte solution may diffuse to the counter electrode and plate out as elemental metal. However, the electrode potential necessary to plate the metal out of solution onto the counter electrode may not be used in the electrochemical cell. In these embodiments, a separate plating circuit or process may be used to remove the metal from the electrolyte solution, as described in more detail below. While a few exemplary geometries of the counter electrode have been described, the geometry of the counter electrode can be varied to increase or decrease the electric field near the PCD element once coupled to a power supply.

The size of the counter electrode 706 may be selected to control the current density present on the surface of the counter electrode. The size of the counter electrode 706 may be selected to provide a greater surface area than the surface area of the working electrode 702 (e.g., the portion of the PCD element exposed to the electrolyte solution). In general, the charge density present on the surface of the counter electrode 706 will decrease as the surface area of the counter electrode 706 increases. In order to avoid the formation of undesired side products at the surface of the counter electrode 706, the ratio of the surface area of the counter electrode 706 to the surface area of the working electrode 702 may be greater than about 1 to 1.1, greater than about 1.5 to 1, greater than about 2 to 1, greater than about 3 to 1, greater than about 4 to 1, or greater than about 5 to 1.

The counter electrode 706 can be positioned near the working electrode 702 within the housing 716. The working electrode 702 and the counter electrode 706 can be generally aligned with each other, and the surfaces of the working electrode 702 and the counter electrode 706 can be generally positioned parallel to each other so that a relatively uniform gap is formed between the two electrodes. The gap can vary depending on the specific arrangement within the housing 716. In an embodiment, the gap will generally be within a range of about 1 millimeter to about 20 centimeters, or between about 1 centimeter to about 10 centimeters. While illustrated in Although FIG. 8 is shown as having the working electrode 702 above the counter electrode 706, the two electrodes can be arranged in any orientation. As noted above, the reference electrode 710 can be placed near the counter electrode 706, but may not generally be placed between the counter electrode 706 and working electrodes 702.

The power source 714 is electrically coupled to the reference electrode 710, the working electrode 702, and the counter electrode 706. In an embodiment, the negative terminal of the power source 714 is electrically coupled to the working electrode 702, and the positive terminal of the power source 714 is electrically coupled to the counter electrode 706, thereby forming an electrical circuit through the electrolyte solution. A resistor may be placed in the electrical circuit to control the current and/or current density supplied to the electrodes. In some embodiments, the power source 714 may determine the electrode potential by measuring the potential of the working electrode relative to the reference electrode. The power source 714 provides electric current to facilitate the reaction of the electrolyte solution 718 with the catalyst material in the PCD element. The power source 714 supplies the current to the working electrode 702 and the counter electrode 706 at an electrode potential selected as described above.

In an embodiment, the power source 714 comprises a potentiostat. A potentiostat allows for the current supplied between the working and counter electrode to be controlled based on measuring and maintaining the potential of the working electrode 702 at a constant level with respect to the reference electrode 710. In order to provide the current, the potentiostat controls the resistance in the circuit to maintain the electrode potential constant. The electrode potential used with the potentiostat can be selected as described above for a specified electrolyte chemistry and catalyst material composition.

In some embodiments, an optional fluid circulation device can be used to create fluid flow within the housing 716. The fluid circulation device can assume the form of an internal fluid circulation device such as the stirring device 720 positioned within the housing 716 or an external fluid circulation device such as a pump disposed in fluid loop outside the housing 716. As shown in FIG. 8, the internal fluid circulation device can comprise a stirrer positioned within the housing 716 such as a magnetic stirring device coupled to a magnetic source through a wall of the housing 716. Alternatively, the internal stirring device can comprise any type of device inserted into the electrolyte solution 718 to create fluid flow. In an embodiment, the fluid circulation device can create fluid flow and/or fluid turbulence over the surface of at least the working electrode.

Referring to FIG. 8, once the electrochemical cell 700 has been set up with the reference, working, and counter electrodes disposed within the housing 716 and in contact with the electrolyte solution 718, the power source 714 can be powered "on" to facilitate the electrochemical corrosion process. The power source 714 may be operated to provide a constant or near constant electrode potential, which may be selected based on a potentiodynamic scan as described above. The electrode potential within the electrochemical cell 700 is measured using the reference electrode 710, and the current supplied between the working electrode 702 and the counter electrode 706 can be varied to maintain the selected electrode potential and/or current density. In an embodiment, the applied electrode potential may generally be between about −0.2 V (SCE) and about 2.5 V (SCE) depending on the specific chemistry of the electrolyte solution and the catalyst material being corroded from the PCD element.

In an embodiment, the electrolyte solution may comprise an iodide ion, for example provided by sodium iodide or hydroiodic acid. The electrochemical cell 700 may be operated to corrode cobalt from a PCD element. For example, the cobalt may be corroded at a constant or near constant electrode potential. During the reaction, the metal cobalt may oxidize to form cobalt(II) iodide which has a high solubility in water. The cobalt iodide may then diffuse out of the diamond matrix to remove the cobalt from the PCD element. The electrolyte solution comprising the iodide ion may comprise any of the optional components described above such as a buffer to adjust the pH of the electrolyte solution.

Figure 9:
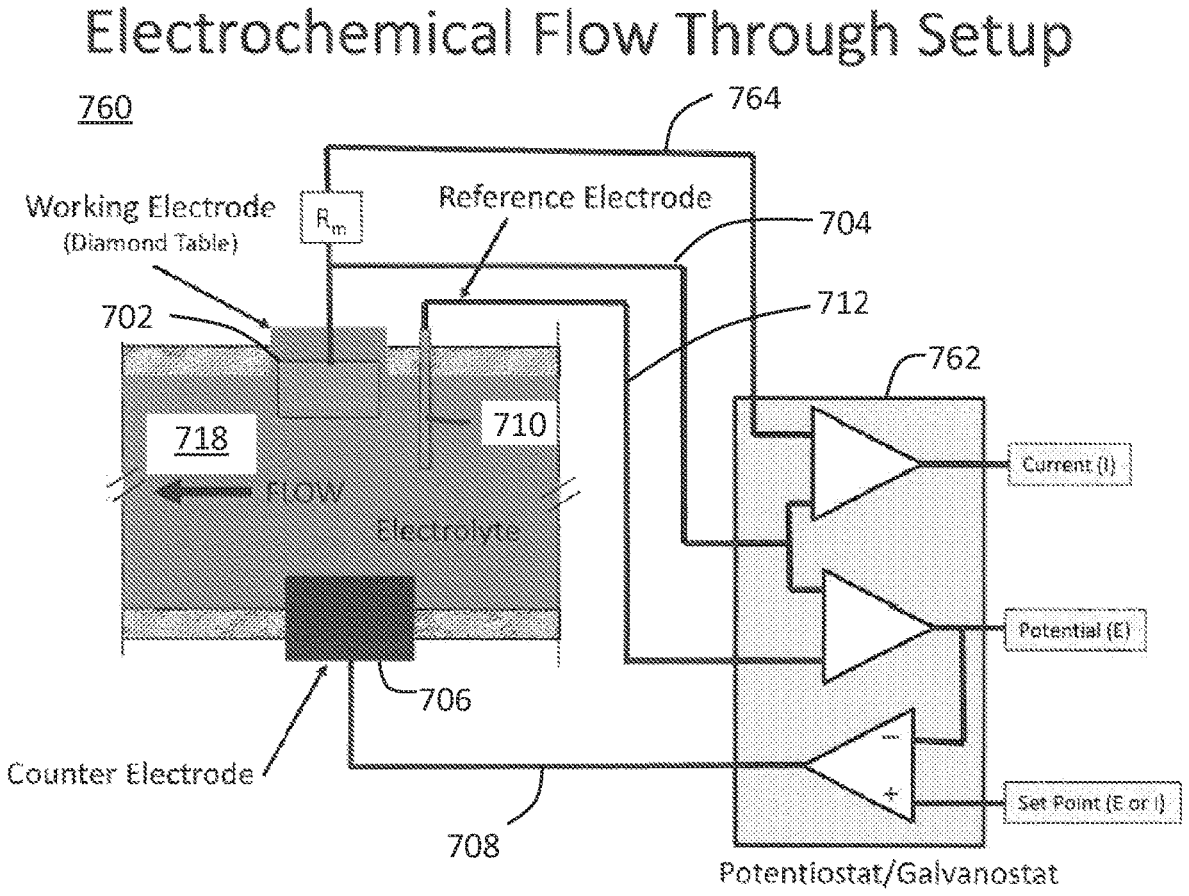
FIG. 9 is still another schematic layout of an electrochemical cell according to an embodiment.

FIG. 9 illustrates a schematic view of an embodiment of an electrochemical cell 760. Various aspects of the electrochemical cell 760 may be the same or similar to the aspects of the electrochemical cell 700 described with respect to FIG. 8 and like components will not be discussed in detail in the interest of clarity. The electrochemical cell 760 combines the functions of the electrochemical cell 700 and with a power source 762 capable of operating in a galvanostatic operational mode. For example, the power source 762 of the electrochemical cell 760 can be used to perform an electrochemical corrosion process in a potentiostatic or galvanostatic fashion.

As shown in FIG. 9, the working electrode 702 is electrically coupled to the power source 762 through an electrical connection 704 leading to an electrode potential detector and through electrical connection 764 to a current or current density detector. The reference electrode 710 is electrically coupled to the power source 762 through an electrical connection 712 to allow the electrode potential of the working electrode 702 to be determined relative to the reference electrode 710. The counter electrode 706 is coupled to the power source 762 through an electrical connection 708. An electrical circuit is formed between the working electrode 702, the power source 762, the counter electrode 706, and the electrolyte solution.

The power source 762 is configured to both determine the working electrode potential and/or the current or current density between the working electrode and the counter electrode. This may allow the power source 762 to operate the electrochemical cell 760 potentiostatically or galvanostatically. In this embodiment, the electrolyte solution can optionally be circulated during the operation of the electrochemical cell 760.

In the galvanostatic mode, the power source is configured to measure the current and/or current density passing through the circuit during the electrochemical corrosion process. The power source can change the electrode potential in order to maintain the current or current density between the electrodes at a constant or near constant value. As described above, the current density used in the galvanostatic electrochemical corrosion process can be selected from a potentiostatic current-time curve obtained from a separate process. In operation, the power source 762 can be powered "on" to facilitate the electrochemical corrosion process. The power source 762 may be operated to provide a constant or near constant current density between the working electrode and the counter electrode, which may be selected based on a potentiostatic current-time curve as described above. The electrode potential of the working electrode can be varied to maintain the selected current density.

While illustrated as a combined potentiostatic/galvanostatic power source 762, it will be appreciated that the power source may be designed to carry out only a single type of corrosion process. In an embodiment, the power source may only be configured to carry out a galvanostatic electrochemical corrosion process. In this embodiment, the reference electrode 710 may not be needed as the electrode potential can change to maintain a constant or near constant current density between the working electrode and the counter electrode. Rather, only a resistance and current measurement is needed.

Figure 10:
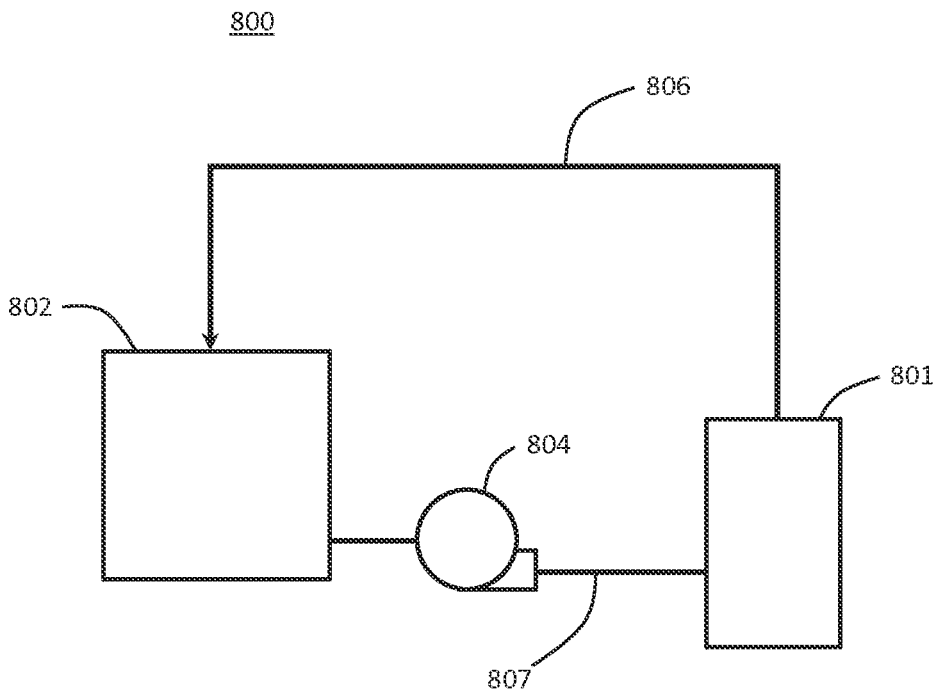
FIG. 10 is a schematic layout of an electrochemical corrosion system having a circulating tank and pump according to an embodiment.

FIG. 10 schematically illustrates an embodiment of a catalyst removal system 800 comprising an external fluid circulation device. As shown in FIG. 10, the electrochemical cell 801 may be coupled to a fluid inlet line 806 and a fluid outlet line 807 allowing the electrolyte solution to be circulated through the electrochemical cell 801. The electrochemical cell 801 may be the same or similar to the electrochemical cell 700, and/or the electrochemical cell 760 described with respect to FIGS. 8 and 9, respectively. A pump 804 may be used to provide the hydraulic driving force to circulate the electrolyte solution from the electrochemical cell 801 to a storage tank 802. The storage tank 802 may be configured to hold a volume of electrolyte solution sufficient to allow the solution to be circulated throughout the fluid loop. In general, the volume of electrolyte solution should be sufficient to avoid the fluid becoming saturated with the corrosion products of the catalyst material. At the saturation point, diffusion to and from the metal-electrolyte solution interface may be limited and undesired species may begin to form within the electrolyte solution. In some embodiments, the volume of electrolyte solution may be sufficient so that the electrolyte solution remains less than about 50%, less than about 40%, less than about 30%, or less than about 20% saturated with the catalyst material corrosion products during the electrochemical corrosion process.

The process described herein may allow for increased catalyst material removal rate from the PCD element through the corrosion of the catalyst material. Removal depths up to 400 to 500 mm can be obtained at removal rates greater than 20 μm per day, greater than 25 μm per day, or greater than 30 μm per day. Rates up to 70 μm per day, 75 μm per day, or 100 μm per day are possible.

During and after the electrochemical corrosion process, the electrolyte solution may contain catalyst material ions. In order to remove the catalyst material ions, the electrolyte solution may be passed through a plating cell to remove the catalyst material from the electrolyte solution. In an embodiment, a plating cell may comprise an electrochemical cell similar to the electrochemical cells 700 and 760 described with respect to FIG. 8 or 9. The cathode may comprise any material suitable for receiving the catalyst material, and in an embodiment, may comprise the catalyst material being corroded from the PCD element. For example, a cobalt cathode may be placed in the plating cell when cobalt is being corroded from the PCD element. The plating cell may be operated at an electrode potential sufficient to plate cobalt onto the electrode from the electrolyte solution. When a circulating system is used with an external source of the electrolyte solution, the plating cell may be positioned within the circulation flowpath. In some embodiments, a separate flowpath in fluid communication with an electrolyte solution storage vessel can be used to receive a portion of the electrolyte solution and return the regenerated electrolyte solution to the fluid loop. As the electrolyte solution passes through the plating cell, a portion of the catalyst material within the electrolyte solution may plate onto the electrode and be removed from the electrolyte solution. The electrolyte solution may then be at least partially regenerated before passing back to the remainder of the system. This may maintain the catalyst metal levels below saturation within the overall system.

Although a single working electrode 702 and corresponding counter electrode 706 are shown immersed in the electrolyte solution 718, a plurality of working electrodes and counter electrodes can be immersed into the electrolyte solution to corrode the catalyst material from the PCD element simultaneously. Alternatively, a working electrode tray having several recessed regions can be used in lieu of working electrode. Each of the recessed region may be capable of receiving at least a portion of the PCD element. In these embodiments, a single reference electrode may be placed upstream of the working and counter electrodes or a plurality of reference electrodes and corresponding power sources may be positioned within a single housing to allow the plurality of working electrodes to be processed to corrode at least a portion of the catalyst material.

During the operation of the system, the removal depth of the catalyst material from the PCD element may be measured, and the process may be continued until the target removal depth is achieved. In an embodiment, the removal depth may be determined by directly observing the PCD element or a portion thereof. In some embodiments, a correlation may be determined between an amount of the catalyst material corroded from the PCD element and an amount of electrical charge transferred between the volume of the PCD element and the counter electrode. In general, the amount of charge transferred is related to the amount of catalyst material corroded from the PCD element as the catalyst material oxidizes and transfers into the electrolyte solution. Taking into account various factors including, but not limited to, the diamond density, the amount of catalyst material present, the geometry of the PCD surface from which the catalyst material is being corroded, and the charge transferred, a correlation between the charge transferred and the catalyst removal depth can be determined.

Using this correlation, at least a portion of the PCD element can be placed in the electrochemical cell and contacted with the electrolyte solution. The electrical current can then be applied between the PCD element and a counter electrode. The application of the electrical current can include any of the processes described herein such as being applied at a substantially constant electrode potential and/or with a circulating fluid. As the catalyst material is being corroded from the PCD element, an amount of electrical charge that is transferred between the PCD element and the counter electrode can be determined over time. For example, the power source may comprise a meter to monitor the applied current, current density, voltage, and/or resistance in the circuit to determine the applied current over time. The applied current and/or current density can be recorded and integrated over time to determine the total amount of charge transferred to the PCD element. The amount of charge transferred can be compared to a predetermined threshold amount of charge that is calculated to allow the catalyst material removal depth to meet or exceed a predetermined removal depth. The predetermined threshold can be based on the correlation. For example, a desired removal depth may be selected, and the correlation may be used to determine the total amount of charge that should be transferred to achieve the desired removal depth.

After the electrochemical corrosion process is carried out according to any of the embodiments described above, the PCD element may be similar to the PCD element before the electrochemical corrosion process except that a portion of the catalyst material is not present within the interstitial spaces between the adjacent diamond grains in the volume of the polycrystalline diamond that is exposed to the process. The catalyst material may be removed from a portion of the PCD element, such as a working surface, and the catalyst material may be removed to a desired depth. The PCD element may then be used for various purposes such as in drill bits, hard facing applications, and the like.

Figure 11:
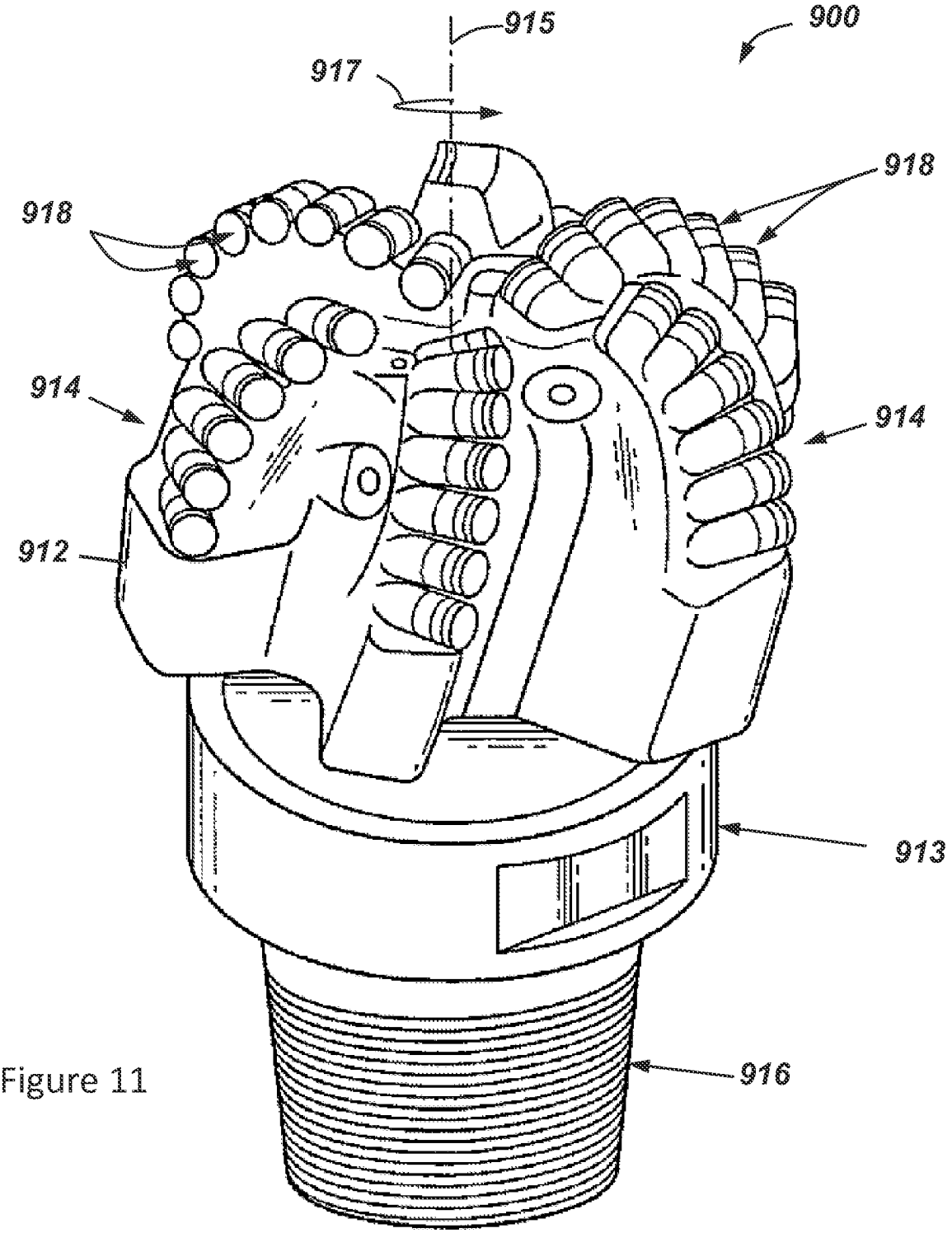
FIG. 11 is a perspective view of a fixed cutter rotary drill bit using an embodiment of a PCD element.

In an embodiment, the PCD element having at least a portion of the catalyst material removed may be used in a drill bit. Referring to FIG. 11, an embodiment of a fixed cutter drill bit 900 is shown. The drill bit 900 has a bit body 912, a shank 913, a threaded pin end 916, and a central longitudinal axis 915 about which the bit 900 can be rotated in a cutting direction 917. The bit 900 also includes a plurality of blades 914 extending along the outside of body 912. A plurality of PCD elements 918 acting as cutter elements manufactured in accordance with the principles described herein are disposed side-by-side along each blade 914 such that each cutter element 918 on a given blade 914 faces the same general direction (i.e., aligned with cutting direction 917). During operation, the bit 900 can be disposed on the end of a drill string (not shown) via the threaded pin end 916, and weight-on-bit ("WOB") can be applied to force the bit 900 against a rock formation. The bit 900 can be rotated about axis 915 in the cutting direction 917, and with WOB applied, the cutter elements 918 can engage the formation and scrape and/or shear portions thereof. As chips of the formation are broken off and transported to the surface with drilling mud, the bit 900 is allowed to advance further into the rock formation along a predetermined trajectory.

Figure 12:
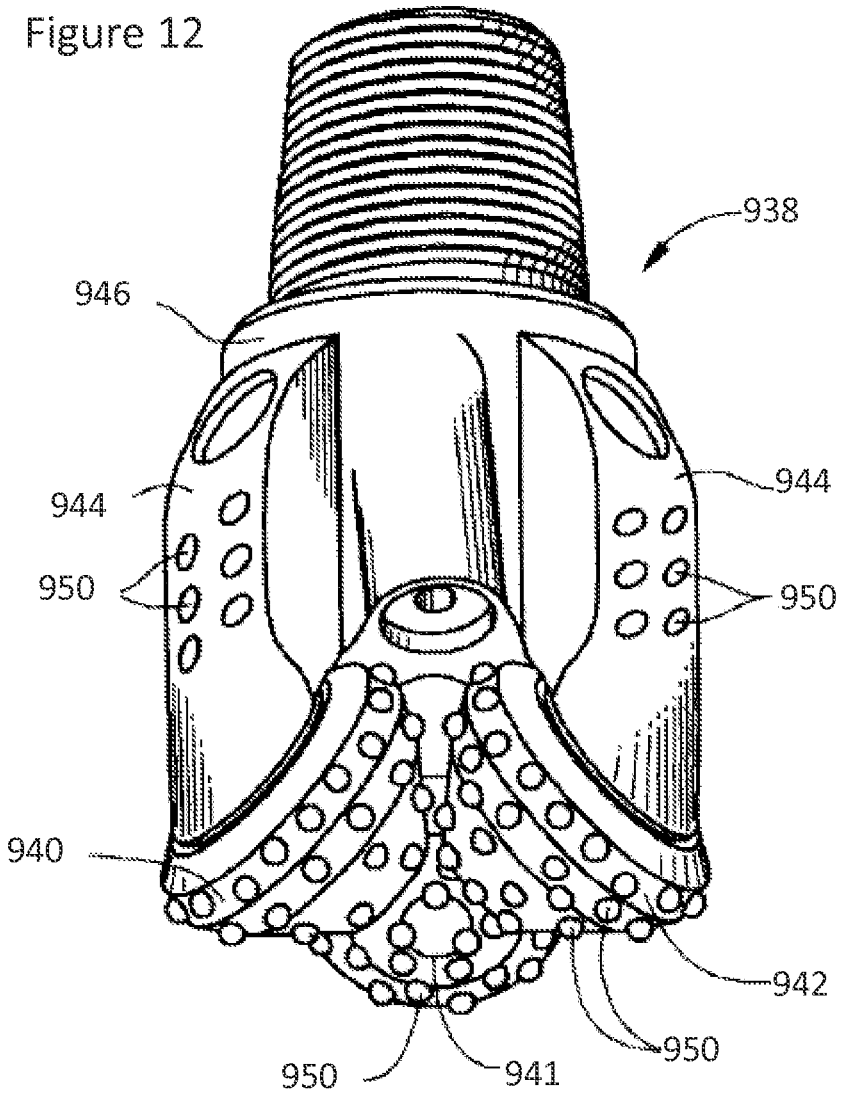
FIG. 12 is a perspective view of a rolling cone cutter rotary drill bit using an embodiment of a PCD element.

In an embodiment, the PCD element manufactured in accordance with the principles described herein may serve as cutter element 950 on a rolling cutter type drill bit 938, shown in FIG. 12. A rolling cutter drill bit 938 typically has one or more truncated rolling cone cutters 940, 941, 942 assembled on a bearing spindle on the leg 944 of the bit body 946. The cutter elements 950 may be mounted as one or more of a plurality of cutter inserts arranged in rows on rolling cutters 940, 941, 942, or alternatively the PCD cutter elements 950 may be arranged along the leg 944 of the bit 938. The PCD cutter element 950 may have a body in the form of the facing table bonded to a less hard substrate or support. The facing table can be in the form of a domed surface. In an embodiment, a number of transitional layers may be disposed between the facing table and the substrate to help more evenly distribute the stresses generated during fabrication. In operation, the rolling cutter drill bit 938 is rotated and weight is applied. This forces the cutter inserts 950 in the rows of the rolling cone cutters 940, 941, 942 into the earth, and as the bit is rotated the rolling cutters 940, 941, 942 turn, effecting a drilling action.

Figure 13:
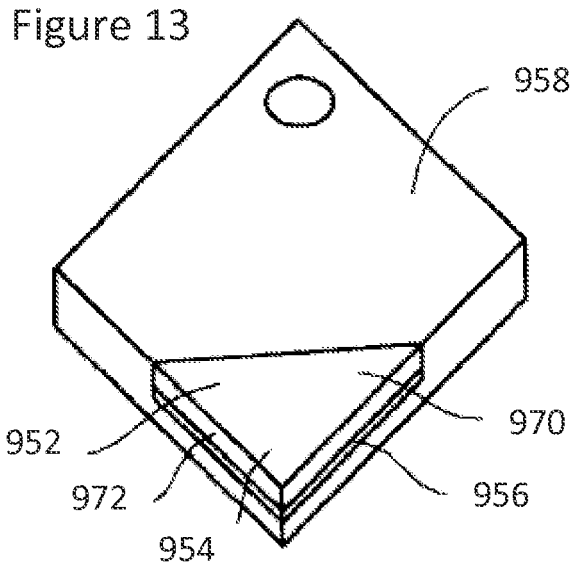
FIG. 13 is a perspective view of an insert used in a machine tool using an embodiment of a PCD element.

In another embodiment, the PCD element can be used in the form of a triangular, rectangular or other shaped material for use as a cutter insert in machining operations as shown in FIG. 13. The cutter insert can be manufactured in accordance with the principles described herein. The cutter element 952 may have a body in the form of a facing table 954 of diamond or diamond like material bonded to a less hard substrate 956 with working surfaces 970 and 972. Typically, the cutter element 952 would then be cut into a plurality of smaller pieces which are subsequently attached to an insert 958 that is mounted in the tool holder of a machine tool. The cutter element 952 may be attached to the insert by brazing, adhesives, welding, or clamping. It is also possible to finish form the cutter element 952 in the shape of the insert in a high-temperature high-pressure manufacturing process.

The PCD elements prepared as described herein may also be used for other applications such as hollow dies. It may also be desirable to utilize the excellent heat transfer capabilities of the PCD element along with its electrical insulation properties as a heat sink. Other suitable applications include friction bearings with a PCD bearing element and the mating parts of a valve with surfaces having a PCD element. In addition, indentors for scribes, hardness testers, surface roughening, etc. may have PCD elements. Punches may have either or both dies made of the PCD material of the present description. Also, tool mandrels and other types of wear elements for measuring devices may be made of PCD elements described herein. It should be understood that almost every application for polycrystalline diamond would benefit from the catalyst material depleted PCD elements prepared according the process and methods described herein.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

Example 1

The corrosion and removal of cobalt from a diamond matrix was studied using several electrolyte solution compositions including: 0.5 N $HNO_3$, 0.1 N HCl, 0.1 N $HNO_3$, and 0.1 N NaI (buffered to a pH of 3.7 using potassium hydrogen phthalate). For each solution, a potentiodynamic scan was performed in an electrochemical test cell comprising the PCD element, the counter electrode, and a reference electrode (saturated calomel electrode). The potentiodynamic scan was performed at an electrode potential between −0.5 V (SCE) and 2.5 V (SCE). Using the results of the potentiodynamic scan, the applied electrode potential was selected at the peak or near peak current density. PCD element samples were then subjected to electrochemical corrosion at the selected electrode potential for each electrolyte solution composition for a period of five days. The cobalt removal depth was measure at the end of the test period. The solution compositions, applied potentials, and removal depths are illustrated in Table 1.

TABLE 1

| Electrolyte Solution Composition | Exposure Time (Days) | Applied Electrode Potential (V (SCE)) | Solution pH | Cobalt Removal Depth (μm) |
|---|---|---|---|---|
| 0.5N $HNO_3$ | 5 | −0.10 | 0.80 | 120 |
| 0.1N HCl | 5 | +0.10 | 0.67 | 200 |
| 0.1N $HNO_3$ | 5 | −0.10 | 1.05 | 300 |
| 0.1N NaI | 5 | +0.40 | 3.7 | 380 |

Having described various systems and method herein, various embodiments can include, but are not limited to:

In a first embodiment, a method of treating a cutter element comprises contacting a volume of polycrystalline diamond with an electrolyte solution, wherein the volume of the polycrystalline diamond comprises interbonded diamond grains and a catalyst material disposed in at least some of the interstitial spaces between adjacent diamond grains; applying an electrical current between the volume of the polycrystalline diamond and a counter electrode, wherein the counter electrode is in contact with the electrolyte solution; maintaining a substantially constant electrochemical potential on the volume of the polycrystalline diamond during the applying of the electrical current; and corroding at least a portion of the catalyst material from the interstitial spaces between the diamond grains.

A second embodiment can include the method of the first embodiment, further comprising: varying the electrical current between the volume of the polycrystalline diamond and the counter electrode to maintain the substantially constant electrochemical potential.

A third embodiment can include the method of the second embodiment, wherein maintaining the substantially constant electrochemical potential comprises maintaining the substantially constant electrochemical potential on the volume of the polycrystalline diamond with respect to a reference electrode.

A fourth embodiment can include the method of any of the first to third embodiments, wherein the catalyst material comprises cobalt.

A fifth embodiment can include the method of any of the first to fourth embodiments, wherein the electrolyte solution comprises a mineral acid having a normality of less than 1.0.

A sixth embodiment can include the method of any of the first to fifth embodiments, wherein the electrolyte solution comprises a halide ion.

A seventh embodiment can include the method of the sixth embodiment, wherein the electrolyte solution comprises iodide ions.

An eighth embodiment can include the method of any of the first to seventh embodiments, wherein the electrolyte solution comprises a buffer.

A ninth embodiment can include the method of any of the first to eighth embodiments, further comprising: circulating the electrolyte solution while applying the electrical current.

A tenth embodiment can include the method of any of the first to ninth embodiments, wherein corroding at least the portion of the catalyst material comprises oxidizing the catalyst material to form a corrosion product that is soluble in the electrolyte solution.

In an eleventh embodiment, a method of treating a cutter element comprises contacting a volume of polycrystalline material with an electrolyte solution, wherein the volume of the polycrystalline material comprises interbonded grains and a catalyst material disposed in at least some of the interstitial spaces between adjacent diamond grains; and potentiostatically corroding at least a portion of the catalyst material from the interstitial spaces between the material grains in the volume of polycrystalline material.

A twelfth embodiment can include the method of the eleventh embodiment, wherein potentiostatically corroding at least the portion of the catalyst material from the interstitial spaces comprises maintaining an electrode potential between the volume of the polycrystalline material and a reference electrode substantially constant while applying a current between the volume of the polycrystalline material and the counter electrode.

In a thirteenth embodiment, a system for treating a cutter element comprises an electrolyte solution; a counter electrode in electrical contact with the electrolyte solution; a volume of polycrystalline diamond in electrical contact with the electrolyte solution, wherein the volume of the polycrystalline diamond comprises interbonded diamond grains and a catalyst material disposed in at least some of the interstitial spaces between adjacent diamond grains in the volume of polycrystalline diamond; and a power source electrically coupled to the counter electrode and the volume of the polycrystalline diamond, wherein the power source is configured to supply an electrical current to maintain a predetermined electrochemical potential between a reference electrode and the volume of polycrystalline diamond to form a corrosion product from the catalyst material, wherein the corrosion product is soluble in the electrolyte solution.

A fourteenth embodiment can include the system of the thirteenth embodiment, further comprising: the reference electrode in electrical contact with the electrolyte solution.

A fifteenth embodiment can include the method of the thirteenth or fourteenth embodiment, wherein the power source comprises a potentiostat configured to supply the electrical current at the predetermined electrochemical potential.

A sixteenth embodiment can include the system of any of the thirteenth to fifteenth embodiments, wherein the catalyst material comprises cobalt.

A seventeenth embodiment can include the system of any of the thirteenth to sixteenth embodiments, wherein the electrolyte solution comprises a mineral acid having a normality of less than 1.0.

An eighteenth embodiment can include the system of any of the thirteenth to seventeenth embodiments, wherein the electrolyte solution comprises a halide ion.

A nineteenth embodiment can include the system of the eighteenth embodiment, wherein the electrolyte solution comprises iodide ions.

A twentieth embodiment can include the system of any of the thirteenth to nineteenth embodiments, wherein the electrolyte solution comprises a buffer.

A twenty first embodiment can include the system of any of the thirteenth to twentieth embodiments, further comprising: a circulation device in contact with the electrolyte solution, wherein the circulation device is configured to circulate the electrolyte solution.

In a twenty second embodiment, a method of treating a cutter element comprises contacting at least a portion of a volume of polycrystalline diamond with an electrolyte solution, wherein the volume of the polycrystalline diamond comprises interbonded diamond grains and a catalyst material disposed in the interstitial spaces between adjacent diamond grains in the volume of polycrystalline diamond; applying an electrical current between the volume of the polycrystalline diamond and a counter electrode, wherein the counter electrode is in contact with the electrolyte solution; circulating the electrolyte solution during the applying of the electrical current; and corroding at least a portion of the catalyst material from the interstitial spaces between the diamond grains in the volume of polycrystalline diamond.

A twenty third embodiment can include the method of the twenty second embodiment, wherein circulating the electrolyte solution comprises using a stirring device within a housing containing the electrolyte solution, the volume of the polycrystalline diamond, and the counter electrode.

A twenty fourth embodiment can include the method of the twenty second embodiment, wherein circulating the electrolyte solution comprises: pumping the electrolyte solution through a housing containing the electrolyte solution, the volume of the polycrystalline diamond, and the counter electrode while applying the electrical current.

A twenty fifth embodiment can include the method of any of the twenty second to twenty fourth embodiments, wherein circulating the electrolyte solution comprises flowing the electrolyte solution over a surface of the polycrystalline diamond in contact with the electrolyte solution.

A twenty sixth embodiment can include the method of any of the twenty second to twenty fifth embodiments, wherein applying the electrical current comprises applying the electrical current at a substantially constant electrode potential.

A twenty seventh embodiment can include the method of the twenty sixth embodiment, wherein the substantially constant electrode potential is maintained between a reference electrode and the volume of polycrystalline diamond, wherein the reference electrode is in contact with the electrolyte solution and is disposed upstream of the volume of polycrystalline diamond.

A twenty eighth embodiment can include the method of any of the twenty second to twenty seventh embodiments, wherein the catalyst material comprises cobalt.

A twenty ninth embodiment can include the method of any of the twenty second to twenty eighth embodiments, wherein the electrolyte solution comprises a mineral acid having a normality of less than 1.0.

A thirtieth embodiment can include the method of any of the twenty second to twenty ninth embodiments, wherein the electrolyte solution comprises a halide ion.

A thirty first embodiment can include the method of the thirtieth embodiment, wherein the electrolyte solution comprises iodide ions.

A thirty second embodiment can include the method of any of the twenty second to thirty first embodiments, wherein the electrolyte solution comprises a buffer.

In a thirty third embodiment, a system for treating a cutter element comprises an electrolyte solution; a counter electrode in electrical contact with the electrolyte solution; a volume of polycrystalline diamond in electrical contact with the electrolyte solution, wherein the volume of the polycrystalline diamond comprises interbonded diamond grains and a catalyst material disposed in the interstitial spaces between adjacent diamond grains in the volume of polycrystalline diamond; a circulation system configured to circulate the electrolyte solution in contact with the volume of polycrystalline diamond; and a power source electrically coupled to the counter electrode and the volume of the polycrystalline diamond, wherein the power source is configured to supply an electrical current between the counter electrode and the volume of polycrystalline diamond to form a corrosion product from the catalyst material, wherein the corrosion product is soluble in the electrolyte solution.

A thirty fourth embodiment can include the system of the thirty third embodiment, further comprising: a housing containing the electrolyte solution, the counter electrode, and the volume of polycrystalline diamond.

A thirty fifth embodiment can include the system of the thirty third embodiment, wherein the circulation system comprises a stirring device within the housing.

A thirty sixth embodiment can include the system of the thirty fourth embodiment, wherein the circulation system comprises a pump configured to circulate fluid through the housing in a fluid loop.

A thirty seventh embodiment can include the system of any of the thirty third to thirty sixth embodiments, further comprising a reference electrode in electrical contact with the electrolyte solution and the power source.

A thirty eighth embodiment can include the system of the thirty seventh embodiment, wherein the reference electrode is disposed upstream of the counter electrode.

A thirty ninth embodiment can include the system of any of the thirty third to thirty eighth embodiments, wherein the power source is further configured to supply the electrical current at a substantially constant electrode potential.

A fortieth embodiment can include the system of any of the thirty third to thirty ninth embodiments wherein the power source comprises a potentiostat.

A forty first embodiment can include the system of any of the thirty third to fortieth embodiments, wherein the catalyst material comprises cobalt.

A forty second embodiment can include the system of any of the thirty third to forty first embodiments, wherein the electrolyte solution comprises a mineral acid having a normality of less than 1.0.

A forty third embodiment can include the system of any of the thirty third to forty second embodiments, wherein the electrolyte solution comprises a halide ion.

A forty fourth embodiment can include the system of the forty third embodiment, wherein the electrolyte solution comprises iodide ions.

A forty fifth embodiment can include the system of any of the thirty third to forty fourth embodiments, wherein the electrolyte solution comprises a buffer.

In a forty sixth embodiment, a method of treating a cutter element comprises contacting at least a portion of a volume of polycrystalline diamond with an electrolyte solution, wherein the volume of the polycrystalline diamond comprises interbonded diamond grains and a catalyst material disposed in the interstitial spaces between adjacent diamond grains in the volume of polycrystalline diamond, and wherein the electrolyte solution comprises an aqueous solution comprising iodide ions; applying an electrical current between the volume of the polycrystalline diamond and a counter electrode, wherein the counter electrode is in contact with the electrolyte solution; forming a corrosion product comprising an iodide salt of the catalyst material, wherein the iodide salt is soluble in the electrolyte solution; and corroding the iodide salt from the interstitial spaces between the diamond grains in the volume of polycrystalline diamond.

A forty seventh embodiment can include the method of the forty sixth embodiment, further comprising circulating the electrolyte solution over the volume of polycrystalline diamond while applying the electrical current.

A forty eighth embodiment can include the system of the forty sixth or forty seventh embodiment, wherein applying the electrical current comprises applying the electrical current at a substantially constant electrode potential.

A forty ninth embodiment can include the system of the forty eighth embodiment, wherein the substantially constant electrode potential is measured between a reference electrode and the volume of polycrystalline diamond.

A fiftieth embodiment can include the system of the forty eighth or forty ninth embodiment, further comprising adjusting the electrical current applied between the volume of the polycrystalline diamond and a counter electrode to maintain the substantially constant electrode potential.

A fifty first embodiment can include the system of any of the forty sixth to fiftieth embodiments, wherein the catalyst material comprises cobalt.

A fifty second embodiment can include the system of any of the forty sixth to fifty first embodiments, wherein the electrolyte solution has a normality of less than 0.5.

A fifty third embodiment can include the system of any of the forty sixth to fifty second embodiments, wherein the electrolyte solution has a pH of less than about 4.0.

A fifty fourth embodiment can include the system of any of the forty sixth to fifty third embodiments, wherein the electrolyte solution comprises a buffer.

In a fifty fifth embodiment, a system for treating a cutter element comprises: an electrolyte solution, wherein the electrolyte solution comprises an aqueous solution comprising iodide ions; a counter electrode in electrical contact with the electrolyte solution; a volume of polycrystalline diamond in electrical contact with the electrolyte solution, wherein the volume of the polycrystalline diamond comprises interbonded diamond grains and a catalyst material disposed in the interstitial spaces between adjacent diamond grains in the volume of polycrystalline diamond; and a power source electrically coupled to the counter electrode and the volume of the polycrystalline diamond, wherein the power source is configured to supply an electrical current between the counter electrode and the volume of polycrystalline diamond to form a corrosion product from the catalyst material, wherein the corrosion product comprises an iodide salt of the catalyst material, and wherein the corrosion product is soluble in the electrolyte solution.

A fifty sixth embodiment can include the system of the fifty fifth embodiment, further comprising: a circulation device configured to circulate the electrolyte solution over the volume of polycrystalline diamond while the power source applies the electrical current.

A fifty seventh embodiment can include the system of the fifty fifth or fifty sixth embodiment, wherein the power source comprises a potentiostat.

A fifty eighth embodiment can include the system of the fifty seventh embodiment, further comprising a reference electrode, wherein the potentiostat is configured to supply the electrical current at a substantially constant electrode potential measured between the reference electrode and the volume of polycrystalline diamond.

A fifty ninth embodiment can include the system of any of the fifty fifth to fifty eighth embodiments, wherein the catalyst material comprises cobalt.

A sixtieth embodiment can include the system of any of the fifty fifth to fifty ninth embodiments, wherein the electrolyte solution has a normality of less than 0.5.

A sixty first embodiment can include the system of any of the fifty fifth to sixtieth embodiments, wherein the electrolyte solution has a pH of less than about 4.0.

A sixty second embodiment can include the system of any of the fifty fifth to sixty first embodiments, wherein the electrolyte solution comprises a buffer.

In a sixty third embodiment, a method of treating a cutter element comprises determining a correlation between an amount of catalyst material corroded from a volume of polycrystalline diamond and an amount of electrical charge transferred between the volume of the polycrystalline diamond and a counter electrode, wherein the volume of the polycrystalline diamond comprises interbonded diamond grains and the catalyst material disposed in the interstitial spaces between adjacent diamond grains in the volume of polycrystalline diamond; contacting at least a portion of the volume of polycrystalline diamond with an electrolyte solution; applying an electrical current between the volume of the polycrystalline diamond and the counter electrode, wherein the counter electrode is in contact with the electrolyte solution; corroding at least a portion of the catalyst material from the interstitial spaces between the diamond grains in the volume of polycrystalline diamond based on the contacting and the applying; determining the amount of electrical charge transferred between the volume of the polycrystalline diamond and the counter electrode based on the determining of the electrical current applied over time; and ceasing the application of the electrical current when the amount of electrical charge transferred between the volume of the polycrystalline diamond and the counter electrode reaches or exceeds a threshold, wherein a depth of the catalyst material corroded from the volume of polycrystalline diamond meets or exceeds a predetermined removal depth.

A sixty fourth embodiment can include the method of the sixty third embodiment, wherein applying the electrical current comprises applying the electrical current at a substantially constant electrode potential, wherein the electrode potential is measured between the volume of polycrystalline diamond and a reference electrode in contact with the electrolyte solution.

A sixty fifth embodiment can include the method of the sixty fourth embodiment, wherein applying the electrical current comprises varying the amount of the electrical current to maintain the substantially constant electrode potential.

A sixty sixth embodiment can include the method of any of the sixty third to sixty fifth embodiments, further comprising circulating the electrolyte solution over the volume of polycrystalline diamond while applying the electrical current.

A sixty seventh embodiment can include the method of any of the sixty third to sixty sixth embodiments, wherein the catalyst material comprises cobalt.

A sixty eighth embodiment can include the method of any of the sixty third to sixty seventh embodiments, wherein the electrolyte solution comprises an iodide ion.

A sixty ninth embodiment can include the method of any of the sixty third to sixty eighth embodiments, wherein the electrolyte solution has a pH of less than about 4.0.

In a seventieth embodiment, a method of treating a cutter element comprises: performing a potentiodynamic scan of a metal in an electrolyte solution; identifying an operating electrode potential within a region of increased current density identified by the potentiodynamic scan; applying an electrical current between a volume of polycrystalline diamond and a counter electrode in an electrochemical cell, wherein the volume of the polycrystalline diamond comprises interbonded diamond grains and a catalyst material disposed in interstitial spaces between adjacent diamond grains in the volume of polycrystalline diamond, wherein the catalyst material comprises the metal, and wherein the electrical current is supplied at the operating electrode potential; and corroding at least a portion of the metal from the interstitial spaces between the diamond grains in the volume of polycrystalline diamond in response to applying the electrical current.

A seventy first embodiment can include the method of the seventieth embodiment, further comprising: identifying a corrosion envelope of the metal, wherein performing the potentiodynamic scan comprises performing the potentiodynamic scan of the metal in the electrolyte solution within an electrode potential range and a pH range identified within the corrosion envelope.

A seventy second embodiment can include the method of the seventieth or seventy first embodiment, further comprising circulating the electrolyte solution over the volume of polycrystalline diamond while applying the electrical current.

A seventy third embodiment can include the method of any of the seventieth to seventy second embodiments, wherein the catalyst material comprises cobalt.

A seventy fourth embodiment can include the method of any of the seventieth to seventy third embodiments, wherein the electrolyte solution comprises an iodide ion.

A seventy fifth embodiment can include the method of any of the seventieth to seventy fourth embodiments, wherein the electrolyte solution has a pH of less than about 4.0.

A seventy sixth embodiment can include the method of any of the seventieth to seventy fifth embodiments, wherein the operating electrode potential is measured between the volume of polycrystalline diamond and a reference electrode.

In a seventy seventh embodiment, a method of treating a cutter element comprises contacting a volume of polycrystalline diamond with an electrolyte solution, wherein the volume of the polycrystalline diamond comprises interbonded diamond grains and a catalyst material disposed in at least some of the interstitial spaces between adjacent diamond grains; and galvanostatically corroding at least a portion of the catalyst material from the interstitial spaces between the diamond grains in the volume of polycrystalline diamond.

A seventy eighth embodiment can include the method of the seventy seventh embodiment, wherein galvanostatically corroding at least the portion of the catalyst material from the interstitial spaces comprises maintaining a substantially constant current density between the polycrystalline diamond and a counter electrode.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of treating a cutter element comprising:

contacting a volume of polycrystalline diamond with an electrolyte solution, wherein the volume of the polycrystalline diamond comprises interbonded diamond grains and a catalyst material disposed in at least some interstitial spaces between adjacent diamond grains;

applying an electrical current between the volume of the polycrystalline diamond and a counter electrode, wherein the counter electrode is in contact with the electrolyte solution, wherein the electrolyte solution is acidic, wherein the electrolyte solution comprises iodide ions, and wherein the iodide ions have a concentration of less than 1.0 N;

maintaining a constant electrochemical potential on the volume of the polycrystalline diamond during the applying of the electrical current;

varying the electrical current between the volume of the polycrystalline diamond and the counter electrode to maintain the constant electrochemical potential; and corroding at least a portion of the catalyst material from the interstitial spaces between the diamond grains.

2. The method of claim 1, wherein maintaining the constant electrochemical potential comprises maintaining the constant electrochemical potential on the volume of the polycrystalline diamond with respect to a reference electrode.

3. The method of claim 1, wherein the catalyst material comprises cobalt.

4. The method of claim 1, wherein the electrolyte solution comprises a mineral acid having a normality of less than 1.0.

5. The method of claim 1, wherein the iodide ions have a concentration of less than 0.3 N.

6. The method of claim 1, wherein the electrolyte solution comprises a buffer.

7. The method of claim 1, further comprising: circulating the electrolyte solution while applying the electrical current.

8. The method of claim 1, wherein corroding at least the portion of the catalyst material comprises oxidizing the catalyst material to form a corrosion product that is soluble in the electrolyte solution.

9. The method of claim 1, wherein maintaining the constant electrochemical potential and the corroding at least the portion of the catalyst material comprise:

potentiostatically corroding at least the portion of the catalyst material from the interstitial spaces between the material grains in the volume of polycrystalline diamond.

10. The method of claim 9, wherein potentiostatically corroding at least the portion of the catalyst material from the interstitial spaces comprises maintaining an electrode potential between the volume of the polycrystalline diamond and a reference electrode constant while applying a current between the volume of the polycrystalline diamond and the counter electrode.

11. A method of treating a cutter element comprising:

contacting a volume of polycrystalline diamond with an electrolyte solution, wherein the electrolyte solution comprises iodide ions and wherein the iodide ions have a concentration of less than 1.0 N, and wherein the volume of the polycrystalline diamond comprises interbonded diamond grains and a catalyst material disposed in at least some interstitial spaces between adjacent diamond grains;

applying an electrical current between the volume of the polycrystalline diamond and a counter electrode, wherein the counter electrode is in contact with the electrolyte solution;

maintaining a constant electrochemical potential on the volume of the polycrystalline diamond during the applying of the electrical current;

varying the electrical current between the volume of the polycrystalline diamond and the counter electrode to maintain the constant electrochemical potential;

corroding at least a portion of the catalyst material from the interstitial spaces between the diamond grains; and circulating the electrolyte solution during the applying of the electrical current, wherein circulating the electrolyte solution comprises: pumping the electrolyte solution through a housing containing the electrolyte solution, the volume of the polycrystalline diamond, and the counter electrode while applying the electrical current, wherein the constant electrode potential is maintained between a reference electrode and the volume of polycrystalline diamond, wherein the reference electrode is in the circulating electrolyte solution and is disposed upstream of the volume of polycrystalline diamond.

12. The method of claim 11, wherein circulating the electrolyte solution comprises using a stirring device within a housing containing the electrolyte solution, the volume of the polycrystalline diamond, and the counter electrode.

13. The method of claim 11, wherein the catalyst material comprises cobalt.

14. The method of claim 11, wherein the electrolyte solution comprises a mineral acid having a normality of less than 1.0.

15. The method of claim 11, wherein the constant electrochemical potential is between about −0.2 V (SCE) and about 2.5 V (SCE).

16. The method of claim 1, wherein the constant electrochemical potential is between about −0.2 V (SCE) and about 2.5 V (SCE).

* * * * *